US008133084B2

(12) United States Patent
Murai et al.

(10) Patent No.: US 8,133,084 B2
(45) Date of Patent: Mar. 13, 2012

(54) PROPULSION DEVICE

(75) Inventors: Hironao Murai, Shizuoka (JP); Morihiro Ooishi, Shizuoka (JP); Makoto Mizutani, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 39 days.

(21) Appl. No.: 12/695,226

(22) Filed: Jan. 28, 2010

(65) Prior Publication Data

US 2010/0120303 A1 May 13, 2010

Related U.S. Application Data

(63) Continuation-in-part of application No. 12/238,516, filed on Sep. 26, 2008, now Pat. No. 7,930,987.

(30) Foreign Application Priority Data

Sep. 28, 2007 (JP) ..... 2007-254165
Jan. 29, 2009 (JP) ..... 2009-017661

(51) Int. Cl.
*B63H 5/125* (2006.01)

(52) U.S. Cl. ..... 440/61 S; 440/61 D

(58) Field of Classification Search ..... 440/61 D, 440/61 S
See application file for complete search history.

(56) References Cited

U.S. PATENT DOCUMENTS 4,041,889 A * 8/1977 Blanchard ..... 440/60
4,074,156 A * 2/1978 Widstrand et al. ..... 310/62
7,311,571 B1 * 12/2007 Swan et al. ..... 440/61 S
2006/0166567 A1 7/2006 Otobe et al.

FOREIGN PATENT DOCUMENTS

JP 06-506887 A 8/1994
JP 2006-199189 A 8/2006
JP 2006-219130 A 8/2006
WO 92/06891 A1 4/1992

OTHER PUBLICATIONS

Mizutani, "Electric Steering Device for Watercraft and Control Method of Electric Steering Device", U.S. Appl. No. 12/238,516, filed Sep. 26, 2008.

* cited by examiner

*Primary Examiner* — Stephen Avila
(74) *Attorney, Agent, or Firm* — Keating & Bennett, LLP

(57) ABSTRACT

A propulsion device includes a propulsion device main body, an attachment mechanism, and a steering mechanism. The attachment mechanism is arranged to attach the propulsion device main body to a hull such that the propulsion device main body turns right and left with respect to the hull about a swivel shaft. Further, the attachment mechanism is arranged to attach the propulsion device main body to the hull such that the propulsion device main body turns up and down with respect to the hull about a tilt shaft. The steering mechanism includes a motor and a transmitting mechanism. The transmitting mechanism is arranged to transmit a driving force of the motor to the propulsion device main body to turn the propulsion device main body to the right or the left. The attachment mechanism includes a housing space in which the motor and the transmitting mechanism are housed.

16 Claims, 28 Drawing Sheets

Prior Art

PROPULSION DEVICE

This application is a Continuation-In-Part of U.S. patent application Ser. No. 12/238,516 filed on Sep. 26, 2008, now U.S. Pat. No. 7,930,987.

BACKGROUND OF THE INVENTION

1. Field of the Invention

The present invention relates to a propulsion device arranged to propel a hull.

2. Description of the Related Art

A propulsion device according to a prior art is an outboard motor described in Japanese Published Unexamined Patent Application No. 2006-219130. The outboard motor includes an outboard motor main body, an attachment mechanism arranged to attach the outboard motor main body to a hull, a steering mechanism arranged to turn the outboard motor main body right and left, and a tilt mechanism arranged to turn the outboard motor main body up and down.

The attachment mechanism includes a swivel bracket coupled to the outboard motor main body so as to turn about a swivel shaft that extends vertically, and a clamp bracket coupled to the swivel bracket so as to turn about a tilt shaft extending horizontally in a right/left direction. The clamp bracket is fixed to a stern plate provided at a rear portion of the hull. The tilt shaft is arranged above the stern plate.

Also, the steering mechanism is arranged in front of the tilt shaft. The steering mechanism is exposed. The steering mechanism includes a ball screw arranged horizontally along the right/left direction, and a motor coupled coaxially to the ball screw. The ball screw is arranged in front of the tilt shaft and at substantially the same height as the tilt shaft. Both end portions of the ball screw are fixed to the swivel bracket. Also, the motor is coupled to the outboard motor main body via a coupling member.

When the motor is driven to rotate, the motor moves in an axial direction along the ball screw. The coupling member is turned to the right or the left about the swivel shaft in accordance with the movement of the motor. The coupling member and the outboard motor main body are thereby turned to the right or the left about the swivel shaft with respect to the hull. Also, when the outboard motor main body and the swivel bracket are turned up about the tilt shaft by the tilt mechanism, the steering mechanism turns about the tilt shaft and approaches the stern plate.

SUMMARY OF THE INVENTION

The inventors of preferred embodiments of the present invention described and claimed in the present application conducted an extensive study and research regarding a propulsion device, such as the one described above, and in doing so, discovered and first recognized new unique challenges and previously unrecognized possibilities for improvements as described in greater detail below.

That is, with the outboard motor according to the prior art, the steering mechanism is exposed. The steering mechanism may thus get wet. Also, other members may collide against the steering mechanism because the steering mechanism is exposed. Thus, even if the steering mechanism is waterproofed, the waterproofing may degrade and water may enter into an inside of the steering mechanism. Further, operating sounds of the steering mechanism are transmitted directly to a user because the steering mechanism is exposed. Yet further, in a case where the steering mechanism is arranged to be attached to attachment mechanism by the user, the precision of attachment of the steering mechanism may vary. Yet further, when the outboard motor main body is turned up by the tilt mechanism, the steering mechanism approaches the stern plate. Thus, for example, in a case where the stern plate has a relatively large plate thickness, the steering mechanism may collide against the stern plate. In a case where the outboard motor is relatively heavy, for example, the plate thickness of the stern plate must be increased to secure the rigidity of the stern plate. However, with the outboard motor according to the prior art described above, it is difficult to increase the plate thickness of the stern plate adequately.

In order to overcome the previously unrecognized and unsolved challenges described above, a preferred embodiment of the present invention provides a propulsion device including a propulsion device main body, an attachment mechanism, and a steering mechanism. The attachment mechanism is arranged to attach the propulsion device main body to a hull such that the propulsion device main body turns right and left with respect to the hull about a swivel shaft arranged to extend vertically. Further, the attachment mechanism is arranged to attach the propulsion device main body to the hull such that the propulsion device main body turns up and down with respect to the hull about a tilt shaft arranged to extend horizontally along a right/left direction. The steering mechanism is arranged to turn the propulsion device main body to the right and the left with respect to the hull. The steering mechanism includes a motor and a transmitting mechanism. The motor is arranged to generate a driving force to turn the propulsion device main body to the right or the left. The transmitting mechanism is arranged to transmit the driving force of the motor to the propulsion device main body to turn the propulsion device main body to the right or the left. The attachment mechanism includes a housing space in which the motor and the transmitting mechanism are housed.

By this arrangement, the motor and the transmitting mechanism are arranged in the housing space provided inside of the attachment mechanism. These structural elements are thereby protected by the attachment mechanism and are thus prevented from getting wet. Also, leakage of operation sounds of these structural elements to the outside is prevented. Further, for example, in a case where these structural elements are housed inside of the attachment mechanism in a process of manufacturing the propulsion device, the user does not have to attach the structural elements to the attachment mechanism when attaching the propulsion device to the hull. Variations of the attachment precision of these structural elements are thus prevented or minimized. Yet further, even in a case where the thickness of the stern plate is large, collision of these structural elements against the stern plate with the turning of the outboard motor main body in the up and down directions is prevented because these structural elements are arranged inside of the attachment mechanism. The thickness of the stern plate can thereby be increased in accordance with the weight of the outboard motor.

The attachment mechanism may include a swivel bracket and a clamp bracket. The swivel bracket may be coupled to the propulsion device main body so as to turn to the right and left about the swivel shaft and may have a front end portion in which the tilt shaft is inserted. The clamp bracket may be coupled to the swivel bracket so as to turn up and down about the tilt shaft. The attachment mechanism may be arranged such that the housing space is positioned rearward relative to the front end portion of the swivel bracket in a state in which the propulsion device main body is arranged at a turning origin in regard to an up/down direction.

Also, the attachment mechanism may be arranged such that the housing space has a length in the right/left direction that is shorter than a length of the propulsion device main body in the right/left direction.

Also, the transmitting mechanism may include a ball screw mechanism including a ball screw and a ball nut, and a gear mechanism arranged to transmit the driving force of the motor to the ball screw. The motor may include an output shaft arranged parallel or substantially parallel to the ball screw and coupled to the ball screw via the gear mechanism.

The attachment mechanism may be arranged such that the housing space is substantially sealed.

The swivel bracket may be arranged to define at least a portion of the housing space. At least a portion of the swivel bracket may be formed of a material containing at least one component among aluminum, copper, nickel, iron, and carbon fiber resin. That is, at least a portion of the swivel bracket may be formed of a material of high thermal conductivity.

Also, the propulsion device may further include a control board arranged to control the motor. The swivel bracket may be arranged to be in contact with at least one of the motor and the control board. Preferably, the swivel bracket may be arranged to be in planar contact with at least one of the motor and the control board.

Also, the swivel bracket may include a recessed portion provided at an outer portion of the swivel bracket and being more recessed than an outer surface of the swivel bracket. The propulsion device may further include a radiating fin attached to the swivel bracket so as to be housed in the recessed portion.

Also, the recessed portion may be provided at the front end portion of the swivel bracket.

Also, the swivel bracket and the radiating fin may be arranged such that the radiating fin can be attached to and detached from the swivel bracket.

Also, the propulsion device may further include a control board arranged to control the motor, and a water flow passage thermally connected to at least one of the motor and the control board and arranged such that water flows therethrough.

Also, the water flow passage may include a first water flow passage provided along the swivel bracket at an outside of the swivel bracket.

Also, the propulsion device may further include a radiating fin attached to an outer portion of the swivel bracket. The first water flow passage may be defined by opposing portions of the swivel bracket and the radiating fin.

Also, the propulsion device may further include a first attachment member arranged inside of the housing space and attached to the motor, and a second attachment member arranged inside of the housing space and attached to the control board. The water flow passage may include a second water flow passage provided inside of the first and second attachment members.

Also, the propulsion device may further include an engine, and a water pump arranged to supply water to the engine and the water flow passage.

Also, the propulsion device may further include a piping connected to the water flow passage and the water pump, and a flow regulating valve interposed in the piping and arranged to regulate a flow rate of water inside the piping.

Also, the motor may include an output shaft. The propulsion device may further include a cooling fan arranged inside the housing space and coupled in an integrally rotatable manner to the output shaft of the motor.

Other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

First, an arrangement of an outboard motor 3A equipped in a marine vessel 1 according to a first preferred embodiment of the present invention shall be described with reference to FIG. 1 to FIG. 8. FWD in the figures indicates a forward drive direction of the marine vessel.

Figure 1:
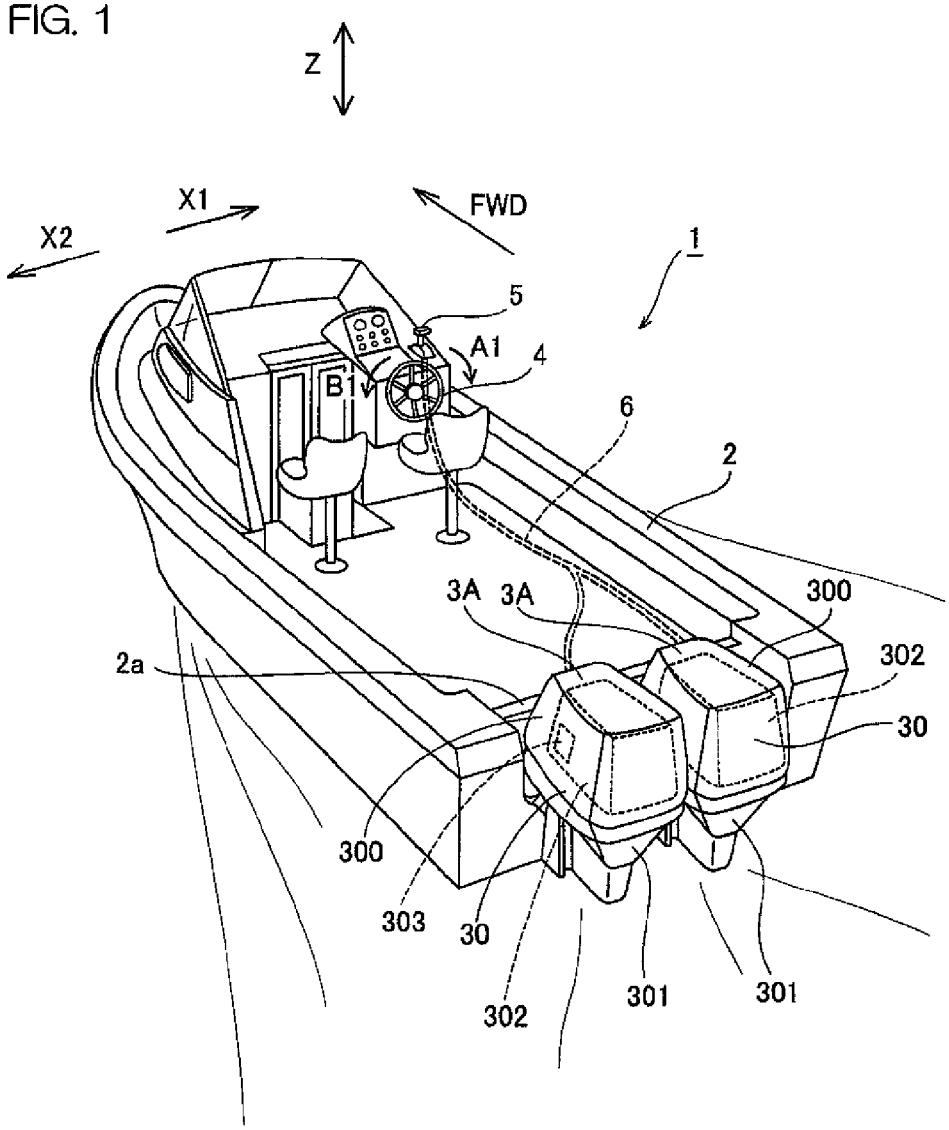
FIG. 1 is a perspective view of a marine vessel equipped with an outboard motor according to a first preferred embodiment of the present invention.

As shown in FIG. 1, the marine vessel 1 includes a hull 2 floating on a water surface, two outboard motors 3A attached to a rear portion of the hull 2, a steering portion 4 arranged to steer the hull 2, and a control lever 5 arranged in a vicinity of the steering portion 4. Each outboard motor 3A is an example of a "propulsion device" according to a preferred embodiment of the present invention. The hull 2 is propelled by the two outboard motors 3A. Switching between forward drive and reverse drive of the hull 2 is performed by the control lever 5. Each outboard motor main body 30 is turned in right and left directions (X1 arrow direction and X2 arrow direction) by operation of the steering portion 4. The hull 2 is thereby steered.

A LAN (local area network) cable 6 electrically connects the respective outboard motors 3A with the steering portion 4 and the respective outboard motors 3A with the control lever 5. The LAN cable 6 transmits an electrical signal from the steering portion 4 to each outboard motor 3A (specifically, a driver 314 arranged inside a swivel bracket 31 (see FIG. 5)). The LAN cable 6 also transmits an electrical signal from the control lever 5 to each outboard motor 3A (specifically, an ECU 303 arranged inside the outboard motor main body 30 (see FIG. 1)). Each ECU (engine control unit) 303 is electrically connected to an engine 302 of an outboard motor 3A. Each ECU 303 controls the engine 302 based on operation of the control lever 5.

Figure 2A:
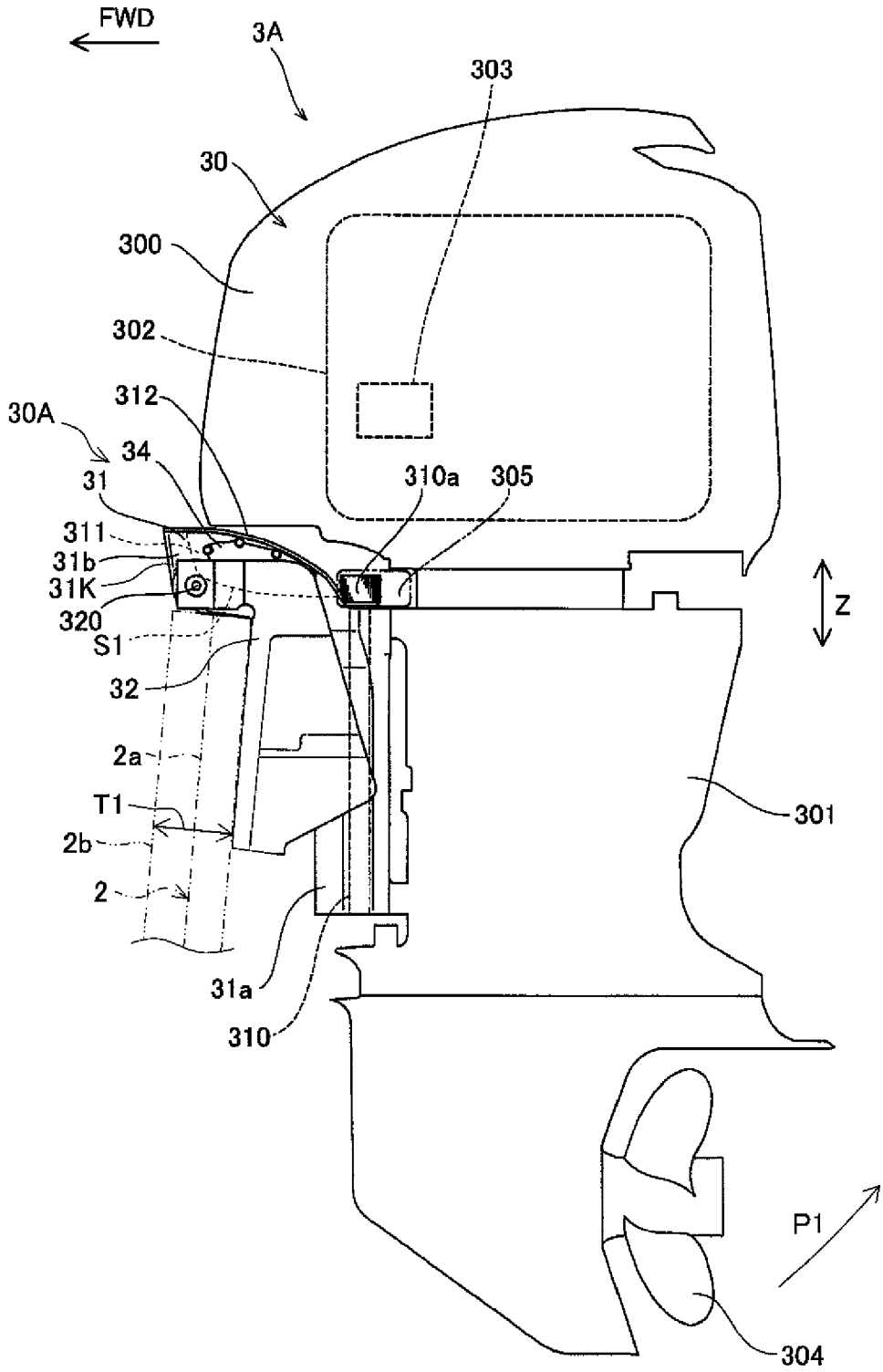
FIG. 2A is a side view of an overall arrangement of the outboard motor according to the first preferred embodiment of the present invention.

As shown in FIG. 2A, the outboard motor 3A includes the outboard motor main body 30, an attachment mechanism 30A, a steering mechanism 311 arranged inside of the attachment mechanism 30A, and a tilt mechanism (not shown). Each outboard motor main body 30 is an example of a "propulsion device main body" according to a preferred embodiment of the present invention. Each outboard motor main body 30 is attached in a substantially vertical orientation to a stern plate 2*a* provided at a rear portion of the hull 2 by the attachment mechanism 30A. Each outboard motor main body 30 is turned in right and left directions about a swivel shaft 310, extending in a vertical direction, by the steering mechanism 311. Also, each outboard motor main body 30 is turned in up and down directions about a tilt shaft 320 extending in a width direction (X1 arrow direction and X2 arrow direction in FIG. 1) of the hull 2. That is, each outboard motor main body 30 is tilted up about the tilt shaft 320 (see P1 arrow in FIG. 2A).

Figure 2B:
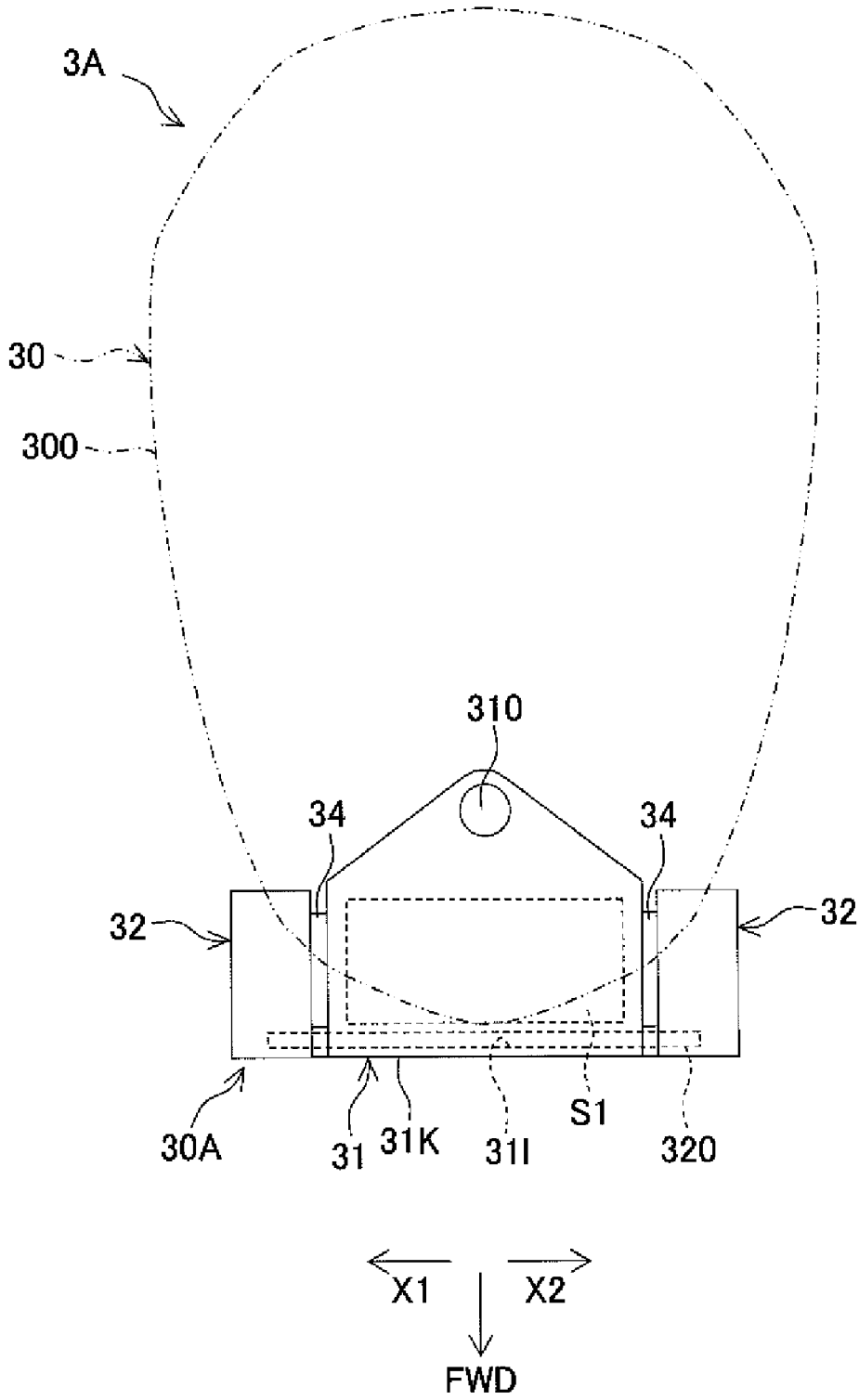
FIG. 2B is a plan view of the overall arrangement of the outboard motor according to the first preferred embodiment of the present invention.
Figure 3:
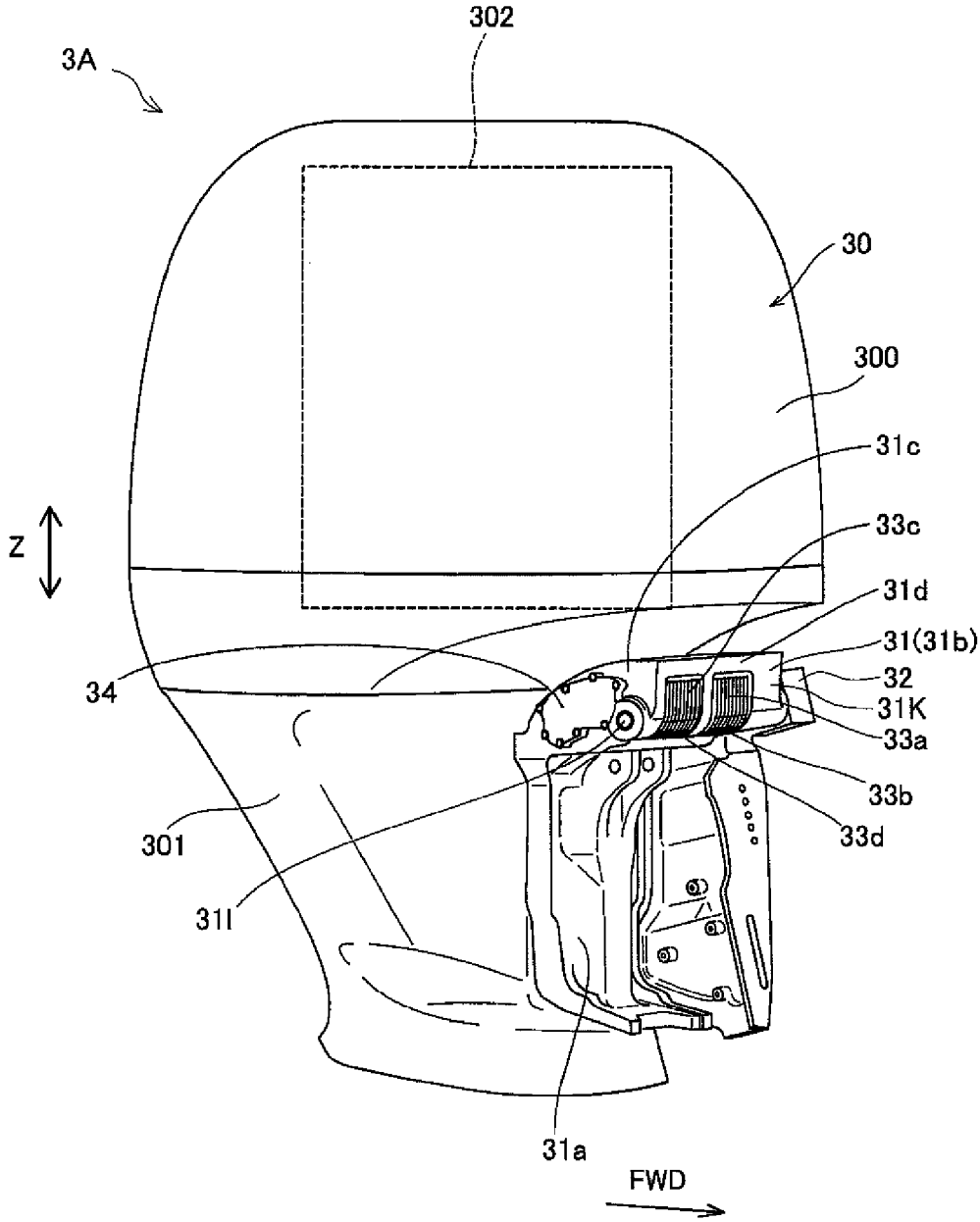
FIG. 3 is a perspective view of the outboard motor according to the first preferred embodiment of the present invention as viewed obliquely from the front.

As shown in FIG. 2B, each attachment mechanism 30A includes the swivel bracket 31, and a pair of clamp brackets 32 arranged at respective right and left sides of the swivel bracket 31. The swivel bracket 31 is preferably formed of a material containing, for example, aluminum. The swivel bracket 31 is lightweight and yet has a high thermal conductivity. Each outboard motor main body 30 is attached to the corresponding swivel bracket 31. The swivel bracket 31 is attached to the respective clamp brackets 32. As shown in FIG. 2A, each clamp bracket 32 is fixed to the stern plate 2*a*. Each outboard motor main body 30 is thus attached to the hull 2 via the swivel bracket 31 and the clamp brackets 32.

The outboard motor main body 30 is coupled to the swivel bracket 31 so as to turn in the right and left directions about the swivel shaft 310. Also, the swivel bracket 31 is coupled to the respective clamp brackets 32 so as to turn in the up and down directions (Z direction) about the tilt shaft 320. The outboard motor main body 30 is turned in the right and left directions about the swivel shaft 310 with respect to the swivel bracket 31 and the respective clamp brackets 32. Also, the outboard motor main body 30 and the swivel bracket 31 are turned in the up and down directions about the tilt shaft 320 with respect to the respective clamp brackets 32.

As shown in FIG. 2A, the swivel shaft 310 includes a spline portion 310*a* provided at an upper portion of the swivel shaft 310. A coupling member 305 coupled to the outboard motor main body 30 is attached to the spline portion 310*a*. The coupling member 305 is arranged to be turned together with the swivel shaft 310. The outboard motor main body 30 is thus turned in the right and left directions about the swivel shaft 310 by the swivel shaft 310 being turned. Also, as shown in FIG. 2B, the tilt shaft 320 penetrates through the swivel bracket 31 in the right/left direction. Respective end portions of the tilt shaft 320 are respectively coupled to the pair of clamp brackets 32.

Also, as shown in FIG. 2A, each outboard motor main body 30 includes an engine cover 300 provided at an upper portion of the outboard motor main body 30, and a case 301 provided below the engine cover 300. The engine 302 and the ECU 303 are housed inside the engine cover 300. Also, a propeller 304 is provided at a lower portion of the case 301. The propeller 304 is driven to rotate by the engine 302.

A structure of the swivel bracket 31 according to the first preferred embodiment shall now be described in detail.

As shown in FIG. 2A, the swivel bracket 31 includes a swivel shaft holding portion 31*a*, and a steering mechanism housing portion 31*b*. The swivel shaft holding portion 31*a* is arranged to extend in the up/down direction. The swivel shaft 310 is held by the swivel shaft holding portion 31*a* in a state of being arranged along the up/down direction. Also, the steering mechanism 311 is arranged inside of the steering mechanism housing portion 31*b*. The steering mechanism 311 is arranged to turn the swivel shaft 310 to thereby turn the outboard motor main body 30 to the right and the left.

Figure 4:
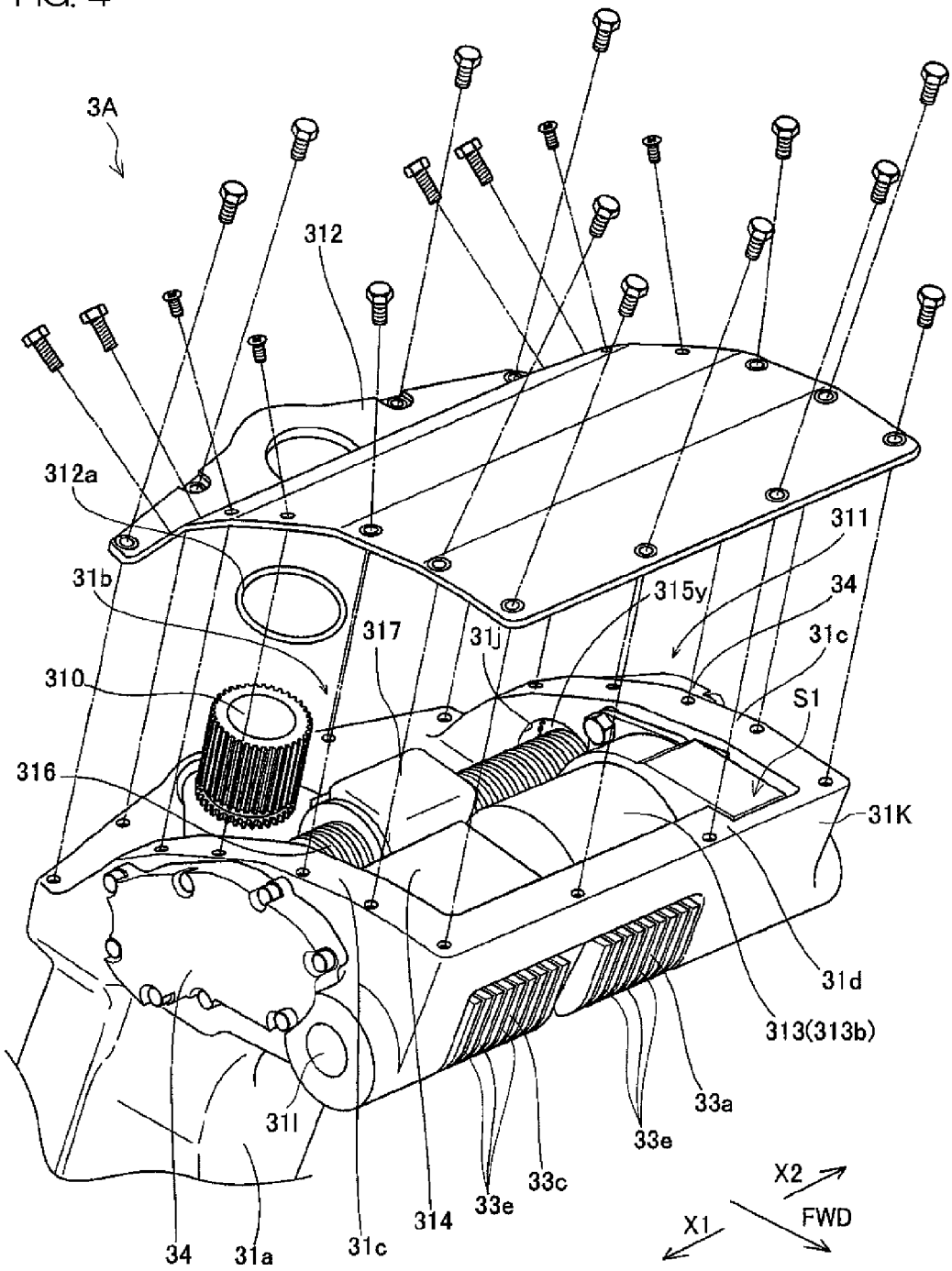
FIG. 4 is a perspective view for explaining an arrangement of a swivel bracket according to the first preferred embodiment of the present invention.

As shown in FIG. 4, the steering mechanism housing portion 31*b* is coupled to an upper portion of the swivel shaft holding portion 31*a*. The steering mechanism housing portion 31*b* is arranged to protrude forward (in a FWD arrow direction) from the upper portion of the swivel shaft holding portion 31*a*. The steering mechanism housing portion 31*b* has a generally cubic shape that is opened at an upper portion and a rear portion. The steering mechanism housing portion 31*b* includes through holes 31*l* provided at a front end portion 31*k* of the steering mechanism housing portion 31*b*. The through holes 31*l* are arranged to penetrate through the steering mechanism housing portion 31*b* in the right/left direction. The tilt shaft 320 is inserted in the through holes 31*l* (see FIG. 2B). The front end portion 31*k* of the steering mechanism housing portion 31*b* is a front end portion of the swivel bracket 31.

Also, as shown in FIG. 4, a cover 312 is arranged to be attached to the upper portion of the steering mechanism housing portion 31*b*. The cover 312 covers an entirety of the opening of the steering mechanism housing portion 31*b*. The cover 312 includes, for example, a generally rectangular plate. Peripheral edge portions of the cover 312 are attached to the upper portion of the steering mechanism housing portion 31*b*, for example, by a plurality of bolts. The cover 312 includes an insertion hole into which an upper portion of the swivel shaft 310 is inserted. Also, the cover 312 is attached to the steering mechanism housing portion 31*b* such that a gap is hardly formed between the peripheral edge portions of the cover 312 and the upper portion of the steering mechanism housing portion 31*b*. Further, in a state in which the cover 312 is attached to the steering mechanism housing portion 31*b*, an interval between the upper portion of the swivel shaft 310 and the cover 312 is sealed by an O-ring 312*a* (see FIG. 4). The inside of the steering mechanism housing portion 31*b* is thereby substantially sealed.

Figure 5:
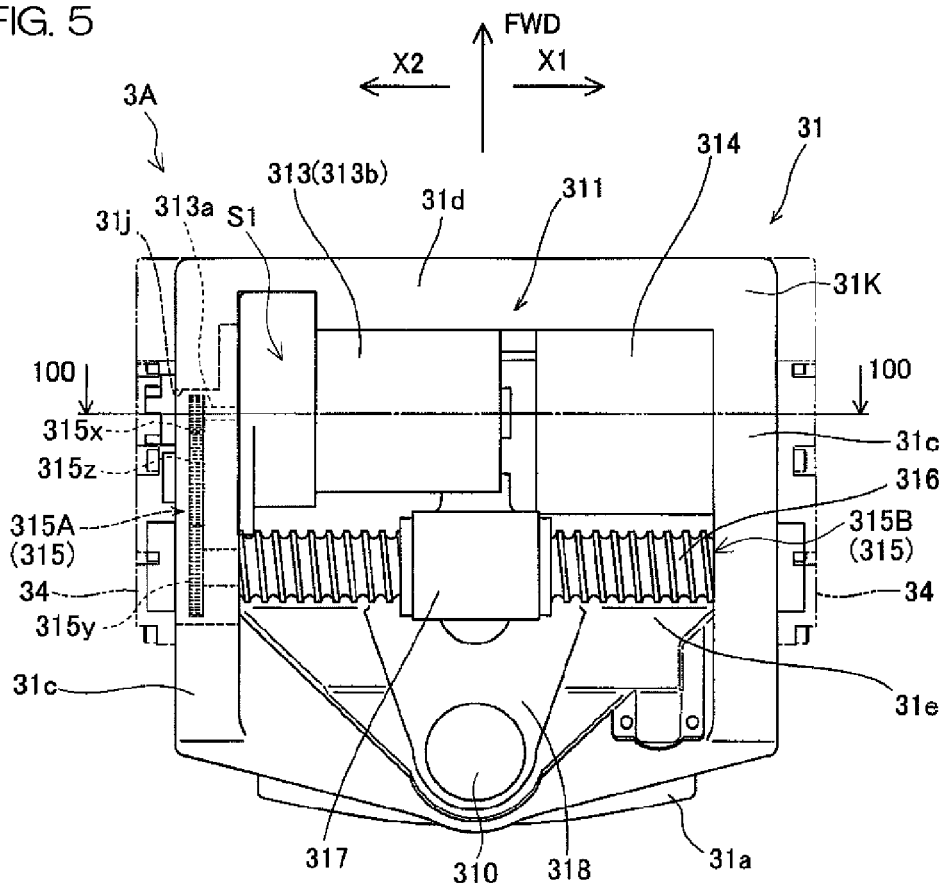
FIG. 5 is a plan view for explaining the arrangement of the swivel bracket according to the first preferred embodiment of the present invention.

Also, as shown in FIG. 5, the steering mechanism housing portion 31*b* includes a pair of side wall portions 31*c* arranged to extend forward and rearward, a front wall portion 31*d* coupling front end portions of the pair of side wall portions 31*c*, and a bottom portion 31*e* coupling lower portions of the pair of side wall portions 31*c*. The pair of side wall portions 31*c* are arranged in parallel or substantially in parallel across an interval in the width direction (X1 arrow direction and X2 arrow direction) of the hull 2. Also, the pair of side wall portions 31*c* are arranged between two plates 34. Each plate 34 is detachably attached, for example, by a plurality of bolts to an outer surface of the corresponding side wall portion 31*c*. The swivel bracket 31 includes a housing space S1 defined by the steering mechanism housing portion 31*b*, the cover 312, and the two plates 34.

The housing space S1 is a substantially sealed space. The steering mechanism 311 is housed in the housing space S1. The housing space S1 is arranged to be positioned at the rear relative to the front end portion 31*k* of the steering mechanism housing portion 31*b* in a state in which the outboard motor main body 30 is arranged at a turning origin in regard to the up/down direction (state shown in FIG. 2A). Also, the housing space S1 has a length in the right/left direction that is shorter than a length in the right/left direction of the outboard motor main body 30 (width of the outboard motor main body 30) (see FIG. 2B).

The "turning origin in regard to the up/down direction" is the position of the outboard motor main body 30 when the swivel shaft 310 is arranged along the vertical direction. Also, the "length of the outboard motor main body 30 in the right/left direction" is the length of the outboard motor main body 30 in the right/left direction in the state in which the outboard motor main body 30 is arranged at a turning origin in regard to the right/left direction (state shown in FIG. 2B).

Also, as shown in FIG. 5, the steering mechanism 311 includes a motor 313, the driver 314, and a transmitting mechanism 315. The motor 313 is arranged to generate a driving force that turns the outboard motor main body 30 in the right or left direction. The motor 313 is controlled by the driver 314. The driver 314 is an example of a "control board" according to a preferred embodiment of the present invention. The driving force of the motor 313 is transmitted to the outboard motor main body 30 by the transmitting mechanism 315. The motor 313, the driver 314, and the transmitting mechanism 315 are housed in the housing space S1. The motor 313, the driver 314, and the transmitting mechanism 315 are thus housed in a narrow, substantially sealed space.

Figure 6:
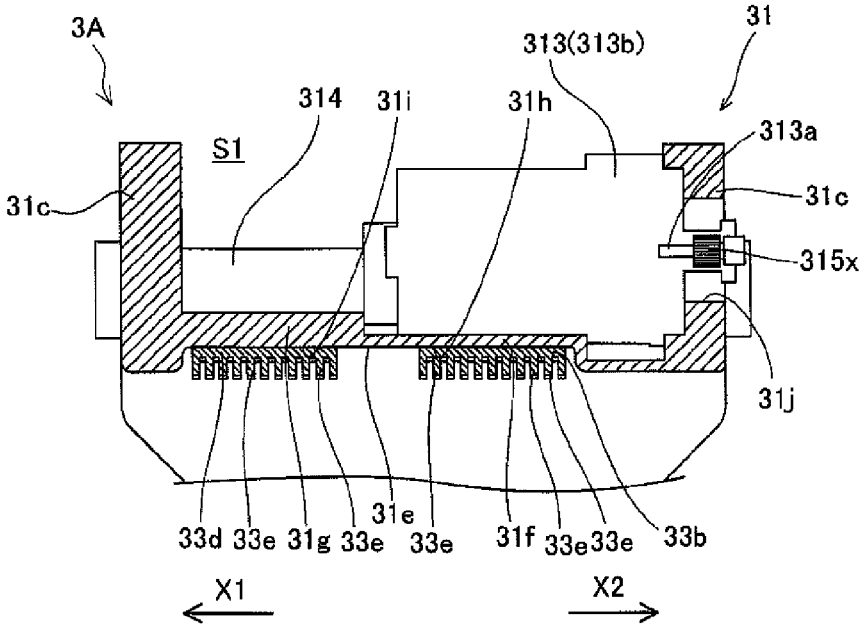
FIG. 6 is a sectional view taken on line 100-100 of FIG. 5.

As shown in FIG. 6, the motor 313 includes an output shaft 313*a*, and a motor main body 313*b* of, for example, a cylindrical shape. The motor 313 is driven to rotate by electricity. As shown in FIG. 5, the motor 313 is arranged along an inner surface of the front wall portion 31*d*. The motor 313 is arranged such that the output shaft 313*a* extends along the width direction of the hull 2. The output shaft 313*a* is arranged to protrude in the width direction of the hull 2 from the motor main body 313*b*. The driver 314 is arranged between the motor 313 and the side wall portion 31*c* at the X1 arrow direction side.

The driver 314 is electrically connected to the motor 313. The driver 314 is arranged to control the motor 313 based on the signal transmitted from the steering portion 4 (see FIG. 1) via the LAN cable 6 (see FIG. 1). Specifically, when the steering portion 4 is rotated in an A1 direction (see FIG. 1), the driver 314 controls the motor 313 to rotate the output shaft 313*a* in one rotation direction. Also, when the steering portion 4 is rotated in a B1 direction (see FIG. 1), the driver 314 controls the motor 313 to rotate the output shaft 313*a* in the other rotation direction opposite the one rotation direction.

Also, as shown in FIG. 5, the transmitting mechanism 315 includes a gear mechanism 315A, a ball screw mechanism 315B, and a transmission plate 318. The gear mechanism 315A is coupled to the motor 313. The ball screw mechanism 315B is coupled to the motor 313 via the gear mechanism 315A. Also, the transmission plate 318 is coupled to the swivel shaft 310. The ball screw mechanism 315B is coupled to the swivel shaft 310 via the transmission plate 318. The driving force of the motor 313 is transmitted to the swivel shaft 310 via the gear mechanism 315A, the ball screw mechanism 315B, and the transmission plate 318. The transmission plate 318 is arranged to turn in the right and left directions about the swivel shaft 310. Also, the swivel shaft 310 is arranged to turn about a central axis in accordance with the turning of the transmission plate 318.

As shown in FIG. 5, the gear mechanism 315A includes an input gear 315*x*, an output gear 315*y*, and an intermediate gear 315*z* engaged with the input gear 315*x* and the output gear 315*y*. The input gear 315*x*, the output gear 315*y*, and the intermediate gear 315*z* are, for example, spur gears, respectively. The input gear 315*x*, the output gear 315*y*, and the intermediate gear 315*z* are aligned from the front to the rear inside an opening portion 31*j* provided in the side wall portion 31*c* at the X2 arrow direction side. Inside the opening portion 31*j*, the input gear 315*x* is coupled to the output shaft 313*a*. The input gear 315*x* is arranged to rotate together with the output shaft 313*a*. The opening portion 31*j* is covered from the side by the plate 34 at the X2 arrow direction side.

Also, as shown in FIG. 5, the ball screw mechanism 315B includes a ball screw 316, a ball nut 317 attached to the ball screw 316, and a plurality of rolling elements (not shown). Grease or other lubricant is applied to sliding surfaces of the ball screw 316 and the ball nut 317. The ball screw 316 is arranged along the width direction of the hull 2. The ball screw 316 and the output shaft 313*a* are arranged in parallel or substantially in parallel. The output gear 315*y* is coaxially coupled to an end portion of the ball screw 316 at the X2 arrow direction side. The output gear 315*y* is arranged to rotate together with the ball screw 316. Also, the rotation of the ball screw 316 is converted to movement of the ball nut 317 in the width direction of the hull 2. The transmission plate 318 is arranged to be turned about the swivel shaft 310 in accordance with the movement of the ball nut 317 in the X1 arrow direction or the X2 arrow direction.

Radiating fins according to the first preferred embodiment of the present invention shall now be described.

Figure 7:
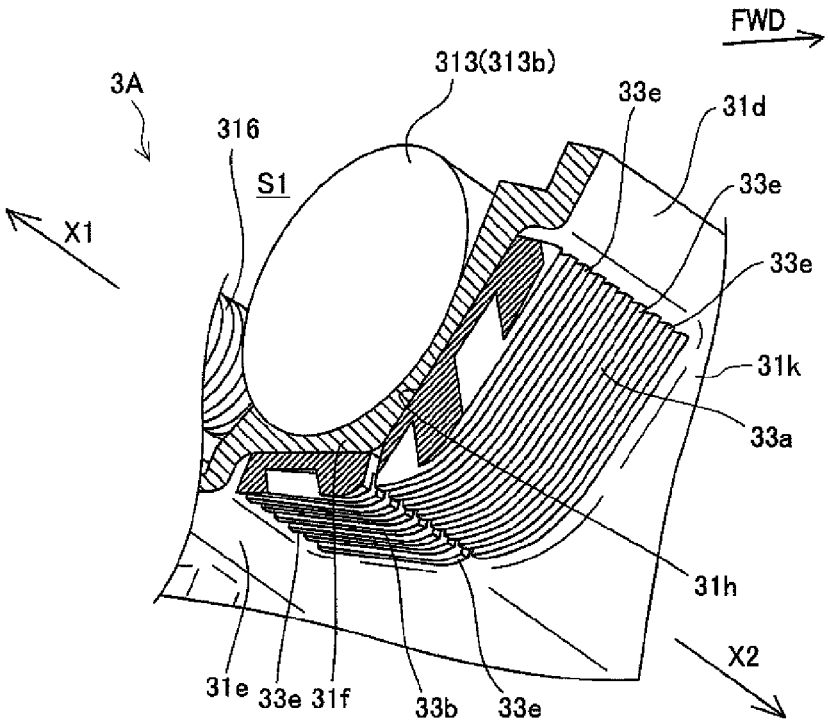
FIG. 7 is a partial sectional view of a motor and an arrangement related thereto according to the first preferred embodiment of the present invention as viewed from below.
Figure 8:
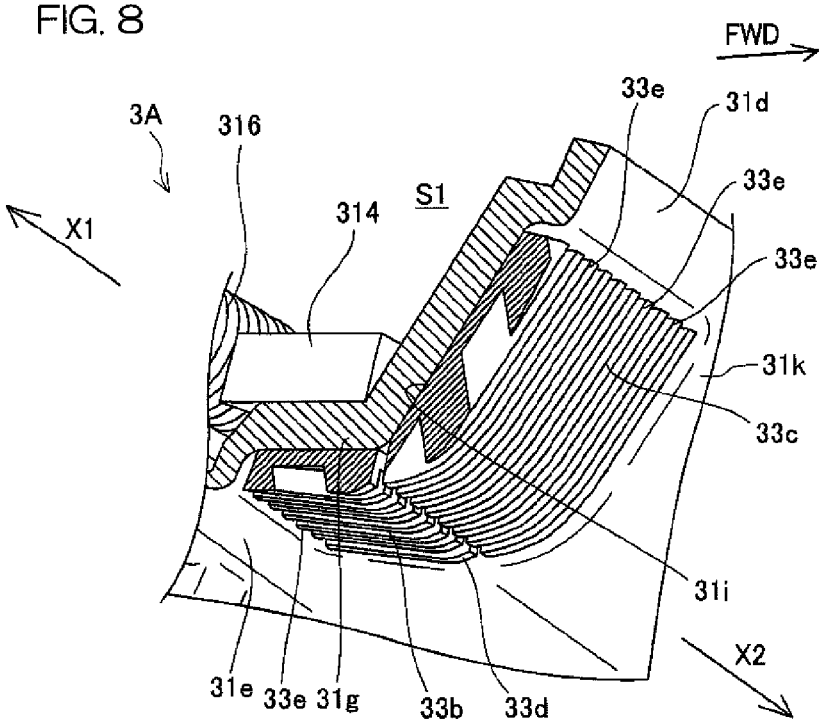
FIG. 8 is a partial sectional view of a driver and an arrangement related thereto according to the first preferred embodiment of the present invention as viewed from below.

As shown in FIG. 7, the steering mechanism housing portion 31*b* includes a fin attachment portion 31*f* provided at the front end portion 31*k* of the steering mechanism housing portion 31*b*. The radiating fins 33*a* and 33*b* are attached to an outer surface 31*h* of the fin attachment portion 31*f*. Also, as shown in FIG. 8, the steering mechanism housing portion 31*b* includes a fin attachment portion 31*g* provided at the front end portion 31*k* of the steering mechanism housing portion 31*b*. The radiating fins 33*c* and 33*d* are attached to an outer surface 31*i* of the fin attachment portion 31*g*. The radiating fins 33*a* and 33*b* and the radiating fins 33*c* and 33*d* are arranged across intervals in the width direction of the hull 2 (see FIG. 3).

Also, as shown in FIG. 7 and FIG. 8, each of the fin attachment portions 31*f* and 31*g* is recessed relative to an outer surface of the steering mechanism housing portion 31*b*. Each of the fin attachment portions 31*f* and 31*g* defines a recessed portion. Each of the two recessed portions defined respectively by the fin attachment portions 31*f* and 31*g* is an example of a "recessed portion" according to a preferred embodiment of the present invention. The radiating fins 33*a* and 33*b* are housed inside the recessed portion defined by the fin attachment portion 31*f*. Likewise, the radiating fins 33*c* and 33*d* are housed inside the recessed portion defined by the fin attachment portion 31*g*.

Also, as shown in FIG. 7 and FIG. 8, each of the fin attachment portions 31*f* and 31*g* is preferably arranged to extend in an L-shaped configuration from a vicinity of an upper end portion of the front wall portion 31*d* to the bottom portion 31*e*. The radiating fins 33*a* and 33*b* are preferably arranged in an L-shaped configuration along the fin attachment portion 31*f*. Likewise, the radiating fins 33*c* and 33*d* are preferably arranged in an L-shaped configuration along the fin attachment portion 31*g*. Each of the radiating fins 33*a* and 33*c* is arranged generally along the up/down direction. Also, each of the radiating fins 33*b* and 33*d* is arranged along the front/rear direction.

Also, as shown in FIG. 7, portions of the radiating fins 33*a* and 33*b* that oppose the fin attachment portion 31*f* have shapes that extend along the outer surface 31*h* of the fin attachment portion 31*f*. Likewise as shown in FIG. 8, portions of the radiating fins 33*c* and 33*d* that oppose the fin attachment portion 31*f* have shapes that extend along the outer surface 31*h* of the fin attachment portion 31*f*. Each of the radiating fins 33*a* and 33*b* is in planar contact with the outer surface 31*h* of the fin attachment portion 31*f*. Likewise, each of the radiating fins 33*c* and 33*d* is in planar contact with the outer surface 31*i* of the fin attachment portion 31*g*. Thermal conduction efficiency across the respective radiating fins 33*a*, 33*b*, 33*c*, and 33*d* and the steering mechanism housing portion 31*b* is thereby made high.

Also, as shown in FIG. 7, a lower portion of the motor 313 (specifically, a lower portion of the motor main body 313*b*) is supported by an inner surface of the fin attachment portion 31*f*. The inner surface of the fin attachment portion 31*f* has a shape corresponding to the lower portion of the motor main body 313*b*. For example, in a case where the motor main body 313*b* has a cylindrical shape and is set on its side, the inner surface of the fin attachment portion 31*f* has a curved surface with an arcuate cross section. The outer surface of the motor main body 313*b* is in planar contact with the inner surface of the fin attachment portion 31*f*. Thermal conduction efficiency across the fin attachment portion 31*g* and the motor 313 is thereby made high.

Also, as shown in FIG. 8, a lower portion of the driver 314 is supported by an inner surface of the fin attachment portion 31*g*. The inner surface of the fin attachment portion 31*g* has a shape corresponding to the lower portion of the driver 314. For example, in a case where the driver 314 has a flat, plate-shaped configuration and is arranged horizontally, the inner surface of the fin attachment portion 31*g* has a flat surface. The outer surface of the driver 314 is in planar contact with the inner surface of the fin attachment portion 31*g*. Thermal conduction efficiency across the fin attachment portion 31*g* and the driver 314 is thereby made high.

The respective radiating fins 33*a*, 33*b*, 33*c*, and 33*d* are formed of a material, for example, containing aluminum. As shown in FIG. 7 and FIG. 8, each of the radiating fins 33*a*, 33*b*, 33*c*, and 33*d* includes a plurality of radiating plates 33*e* that are arranged in parallel or substantially in parallel across intervals. Each of the radiating fins 33*a* and 33*c* arranged along the front wall portion 31*d* of the steering mechanism housing portion 31*b* is arranged such that the respective radiating plates 33*e* extend generally vertically. Also, each of the radiating fins 33*b* and 33*d* arranged along the bottom portion 31*e* of the steering mechanism housing portion 31*b* is arranged such that the respective radiating plates 33*e* extend forward and rearward.

The respective radiating fins 33*a*, 33*b*, 33*c*, and 33*d* are attached to the front end portion 31*k* of the steering mechanism housing portion 31*b* because the fin attachment portions 31*f* and 31*g* are provided at the front end portion 31*k* of the steering mechanism housing portion 31*b*. Thus, in comparison to cases of being attached to a rear portion or a side portion of the steering mechanism housing portion 31*b*, the respective radiating fins 33*a*, 33*b*, 33*c*, and 33*d* readily receive an airstream flowing to the rear. Also, the respective radiating plates 33*e* are arranged along the up/down direction or the front/rear direction, and thus the airstream flowing to the rear hits the respective radiating plates 33*e* uniformly and flows to the rear along the radiating plates 33*e*. Heat is thus radiated efficiently from the respective radiating fins 33*a*, 33*b*, 33*c*, and 33*d*.

Next, examples of technical effects and merits of the outboard motor 3A according to the first preferred embodiment of the present invention shall now be described.

With the first preferred embodiment, the motor 313, the driver 314, and the transmitting mechanism 315 are arranged in the housing space S1 provided inside of the attachment mechanism 30A. These structural elements are thereby protected by the attachment mechanism 30A. These structural elements are thus prevented from getting wet. Also, leakage of operation sounds of these structural elements to the outside is prevented. Further, the housing space S1 is substantially sealed. Therefore these structural elements are reliably prevented from getting wet. Also, leakage of operation sounds of these structural elements to the outside is reliably prevented. Yet further, for example, in a case where these structural elements are housed inside of the attachment mechanism 30A in a process of manufacturing the outboard motor 3A, the user does not have to attach the structural elements to the attachment mechanism 30A when attaching the outboard motor 3A to the hull 2. Variation of the attachment precision of these structural elements is thus prevented or minimized. Yet further, even in a case where the thickness of the stern plate 2*a* is large, collision of these structural elements against the stern plate 2*a* with the turning of the outboard motor main body 30 in the up and down directions is prevented because these structural elements are arranged inside of the attachment mechanism 30A. The thickness of the stern plate 2*a* can thereby be increased in accordance with the weight of the outboard motor 3A. Specifically, even in a case where the outboard motor 3A is attached to the stern plate 2*b* having an adequate thickness T1 as shown in FIG. 2A, the collision of the structural elements against the stern plate 2*b* with the turning of the outboard motor main body 30 in the up and down directions is prevented.

Also, with the first preferred embodiment, the tilt shaft 320 penetrates in the right/left direction through the through holes 31*l* provided in the front end portion (front end portion 31*k*) of the swivel bracket 31. The housing space S1, in which the motor 313, the driver 314, and the transmitting mechanism 315 are housed, is arranged to be positioned to the rear relative to the front end portion of the swivel bracket 31 in the state in which the outboard motor main body 30 is arranged at the turning origin in regard to the up/down direction. An entirety or a large portion of the housing space 51 is thus arranged to the rear relative to the tilt shaft 320 in the state in which the outboard motor main body 30 is arranged at the turning origin in regard to the up/down direction. An adequate distance is thereby secured between structural elements and the stern plate 2*a* about the tilt shaft 320. Thus, when a turning angle of the outboard motor main body 30 is not more than a predetermined value (for example, not more than approximately 90 degrees), the collision of the structural elements against the stern plate 2*a* with the turning of the outboard motor main body 30 in the up and down directions is prevented reliably.

Also, with the first preferred embodiment, the housing space 51 has the length in right/left direction that is shorter than the length in the right/left direction of the outboard motor main body 30. A width (length in the right/left direction) of an entirety of the attachment mechanism 30A is thereby reduced. Thus, in a case where a plurality of outboard motors 3A are attached to the stern plate 2*a* in a substantially parallel state, an interval between two adjacent outboard motor main bodies 30 is reduced. A plurality of outboard motors 3A can thus be attached reliably to the stern plate 2*a*.

Also, with the first preferred embodiment, the output shaft 313*a* of the motor 313 is coupled to the ball screw 316 by the gear mechanism 315A. The driving force of the motor 313 is transmitted to the ball screw 316 by the gear mechanism 315A. The output shaft 313*a* of the motor 313 and the ball screw 316 are arranged in parallel or substantially in parallel in the housing space S1. Thus, in comparison to a case where the output shaft 313*a* of the motor 313 and the ball screw 316 are not parallel or not substantially parallel, an area occupied by the motor 313, the ball screw mechanism 315B, and the gear mechanism 315A is reduced. Further, the motor 313, the ball screw mechanism 315B, and the gear mechanism 315A are arranged on substantially the same plane, and thus a volume occupied by the motor 313, the ball screw mechanism 315B, and the gear mechanism 315A is reduced. The motor 313, the ball screw mechanism 315B, and the gear mechanism 315A are thereby housed reliably in a narrow, limited space (housing space S1).

Also, with the first preferred embodiment, the swivel bracket 31 is preferably formed of the material containing aluminum, for example. The swivel bracket 31 thus has a high thermal conductivity. Heat of the swivel bracket 31 itself and heat of the inside of the swivel bracket 31 are thus radiated efficiently to the outside of the swivel bracket 31. The swivel bracket 31 itself and the inside of the swivel bracket 31 are thereby cooled. The structural elements arranged inside of the swivel bracket 31, such as the motor 313, the driver 314, the transmitting mechanism 315, etc., are thus cooled. Thus, even in a case where the motor 313 and the driver 314 are arranged in the substantially sealed space, increases in temperature of the motor 313 and the driver 314 are prevented or minimized. Softening of the lubricant applied to the ball screw 316, etc., caused by temperature rise is also prevented. Scattering of the lubricant inside the housing space S1 is thereby prevented.

Also, with the first preferred embodiment, the motor 313 and the driver 314 are in planar contact with the swivel bracket 31. Heat is thus conducted efficiently from the motor 313 and the driver 314 to the swivel bracket 31. The motor 313 and the driver 314 are thereby cooled efficiently.

Also, with the first preferred embodiment, the two recessed portions respectively defined by the fin attachment portions 31*f* and 31*g* are provided at portions of the outer side of the swivel bracket 31. The respective radiating fins 33*a*, 33*b*, 33*c*, and 33*d* are attached to the swivel bracket 31 so as to be housed in the corresponding recessed portions. The heat of the swivel bracket 31 itself and the heat of the inside of the swivel bracket 31 are thus released efficiently to the outside of the swivel bracket 31 via the respective radiating fins 33*a*, 33*b*, 33*c*, and 33*d*. The structural elements arranged inside of the swivel bracket 31, such as the motor 313, the driver 314, the transmitting mechanism 315, etc., are thereby cooled further. Also, collision of the respective radiating fins 33*a*, 33*b*, 33*c*, and 33*d* against the stern plate 2*a*, etc., is prevented because the respective radiating fins 33*a*, 33*b*, 33*c*, and 33*d* are housed in the corresponding recessed portions.

Also, with the first preferred embodiment, the two recessed portions respectively defined by the fin attachment portions 31*f* and 31*g* are provided at the front end portion of the swivel bracket 31. The respective radiating fins 33*a*, 33*b*, 33*c*, and 33*d* are thus attached to the front end portion of the swivel bracket 31. Thus, in comparison to cases where the respective radiating fins 33*a*, 33*b*, 33*c*, and 33*d* are attached to the rear portion or the side portion of the steering mechanism housing portion 316, the respective radiating fins 33*a*, 33*b*, 33*c*, and 33*d* readily receive an airstream flowing to the rear. Heat is thereby released efficiently from the respective radiating fins 33*a*, 33*b*, 33*c*, and 33*d*. The structural elements arranged inside of the swivel bracket 31, such as the motor 313, the driver 314, the transmitting mechanism 315, etc., are thereby cooled further. Also, collision of the respective radiating fins 33*a*, 33*b*, 33*c*, and 33*d* against the stern plate 2*a* with the turning of the outboard motor main body 30 in the up and down directions is prevented because the respective radiating fins 33*a*, 33*b*, 33*c*, and 33*d* are housed in the corresponding recessed portions.

Also, with the first preferred embodiment, the respective radiating fins 33*a*, 33*b*, 33*c*, and 33*d* are detachably attached to the swivel bracket 31. The respective radiating fins 33*a*, 33*b*, 33*c*, and 33*d* can thus be removed according to the circumstances. Specifically, for example, in a case where there is a large temperature difference between the swivel bracket 31, cooled by the respective radiating fins 33*a*, 33*b*, 33*c*, and 33*d*, and ambient air, the respective radiating fins 33*a*, 33*b*, 33*c*, and 33*d* are removed from the swivel bracket 31. Occurrence of dew condensation inside of the swivel bracket 31 caused by temperature difference is thereby prevented. The motor 313 and the driver 314 are thereby prevented from getting wet.

Second Preferred Embodiment

An outboard motor 3B according to a second preferred embodiment of the present invention shall now be described with reference to FIG. 9 to FIG. 12.

Figure 9:
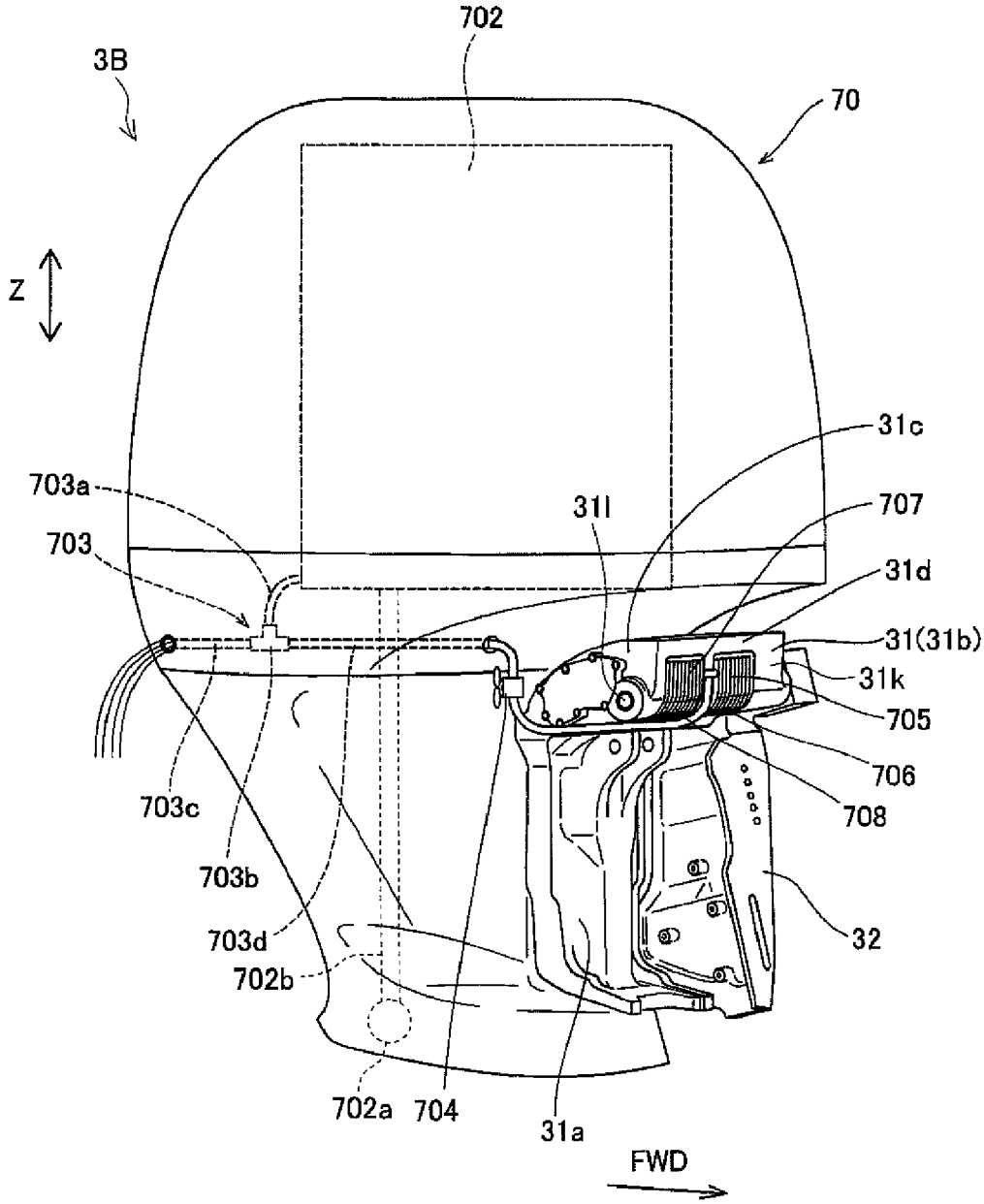
FIG. 9 is a perspective view of an outboard motor according to a second preferred embodiment of the present invention as viewed obliquely from the front.

As shown in FIG. 9, the outboard motor 3B includes a water pump 702*a* arranged to supply water to an engine 702, and a piping unit 703 arranged to discharge the water supplied to the engine 702. The water pump 702*a* is arranged to feed water at the outside of the outboard motor 3B to the engine 702. The water pump 702*a* is connected to the engine 702 by a piping 702*b*. The water pump 702*a* includes an impeller (not shown). The impeller of the water pump 702*a* is coupled to a driveshaft (not shown) that is rotated by the engine 702. A supply flow rate of water from the water pump 702*a* to the engine 702 increases in accordance with an increase of a rotational speed of the engine 702.

Also, the piping unit 703 includes an upstream side discharge pipe 703*a*, a joint 703*b*, a downstream side discharge pipe 703*c*, a branch pipe 703*d*, and a flow regulating valve 704. A first end portion of the upstream side discharge pipe 703*a* is connected to the engine 702. A first end portion of the downstream side discharge pipe 703*c* is connected to a second end portion of the upstream side discharge pipe 703*a* via the joint 703*b*. Likewise, a first end portion of the branch pipe 703*d* is connected to the second end portion of the upstream side discharge pipe 703*a* via the joint 703*b*. A second end portion of the downstream side discharge pipe 703*c* is connected to an opening provided in an outer surface of an outboard motor main body 70. Also, a second end portion of the branch pipe 703*d* is connected to the swivel bracket 31.

The joint 703*b* has three openings (not shown). The upstream side discharge pipe 703*a*, the downstream side discharge pipe 703*c*, and the branch pipe 703*d* are respectively connected to different openings. Also, as shown in FIG. 9, a portion of the branch pipe 703*d* is arranged outside of the outboard motor main body 70. The flow regulating valve 704 is interposed in the portion of the branch pipe 703 arranged outside of the outboard motor main body 70. The flow regulating valve 704 is, for example, a manual valve. The flow regulating valve 704 is arranged at a position enabling operation by a user.

A portion of the water supplied to the engine 702 from the water pump 702*a* passes through the inside of the engine 702 and is discharged to the upstream side discharge pipe 703*a*. Also, a portion of the water discharged into the upstream side discharge pipe 703*a* is supplied to the downstream side discharge pipe 703*c* through the joint 703*b*. The portion of the water discharged into the upstream side discharge pipe 703*a* is thereby discharged to the outside of the outboard motor main body 70. Also, a portion of the water discharged to the upstream side discharge pipe 703*a* is supplied to the branch pipe 703*d* through the joint 703*b*. The portion of the water discharged to the upstream side discharge pipe 703*a* is thereby supplied to the swivel bracket 31. The supply flow rate of water from the branch pipe 703*d* to the swivel bracket 31 is regulated by an opening degree of the flow regulating valve 704. Thus, even if the supply flow rate of water from the water pump 702*a* to the engine 702 increases, a fixed flow rate of water that is in accordance with the opening degree of the flow regulating valve 704 is supplied to the swivel bracket 31.

Next, radiating fins according to the second preferred embodiment of the present invention shall now be described.

Figure 10:
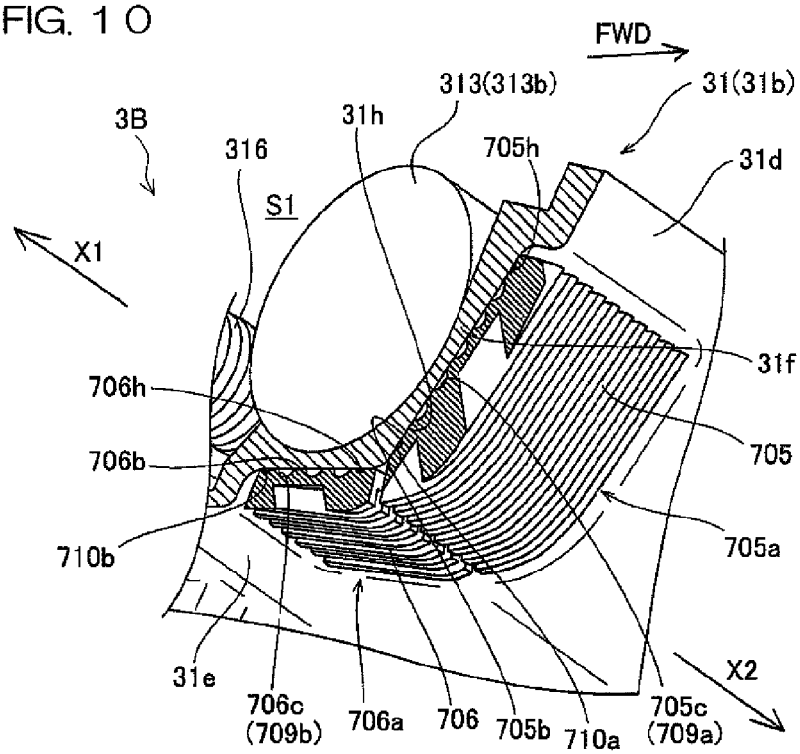
FIG. 10 is a partial sectional view of a motor and an arrangement related thereto according to the second preferred embodiment of the present invention as viewed from below.
Figure 11:
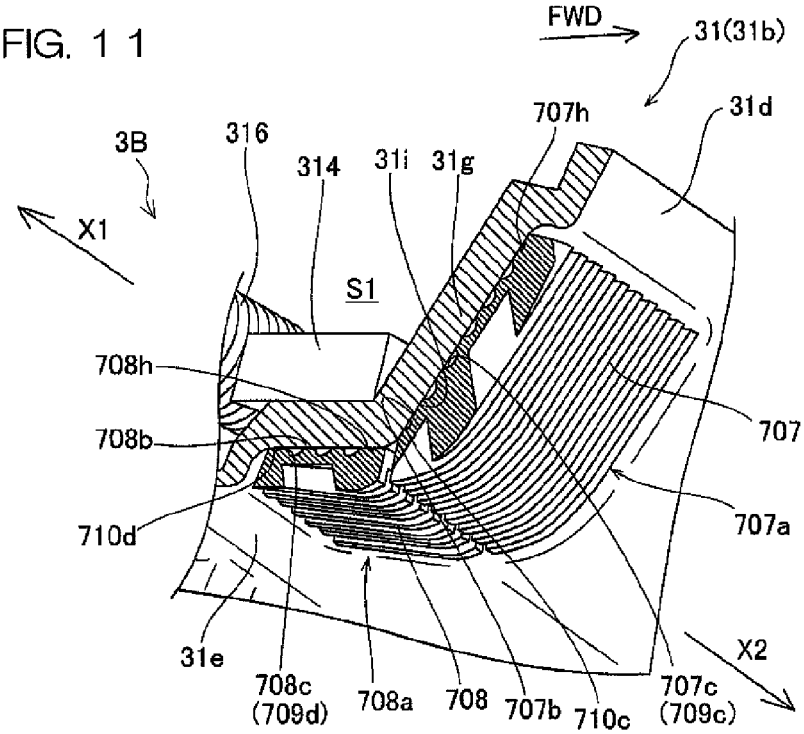
FIG. 11 is a partial sectional view of a driver and an arrangement related thereto according to the second preferred embodiment of the present invention as viewed from below.

As shown in FIG. 10, radiating fins 705 and 706 are attached to the outer surface 31*h* of the fin attachment portion 31*f*. Also, as shown in FIG. 11, radiating fins 707 and 708 are attached to the outer surface 31*i* of the fin attachment portion 31*g*. The radiating fins 705 and 706 are housed inside the recessed portion defined by the fin attachment portion 31*f*. The radiating fins 705 and 706 are arranged preferably in an L-shaped configuration along the fin attachment portion 31*f*. Likewise, the radiating fins 707 and 708 are housed inside the recessed portion defined by the fin attachment portion 31*g*. The radiating fins 707 and 708 are arranged preferably in an L-shaped configuration along the fin attachment portion 31*g*.

Also, as shown in FIG. 10, portions (opposing surfaces 705*b* and 706*b*) of the radiating fins 705 and 706 that oppose the fin attachment portion 31*f* have shapes that extend along the outer surface 31*h* of the fin attachment portion 31*f*. Likewise, as shown in FIG. 11, portions (opposing surfaces 707*b* and 708*b*) of the radiating fins 707 and 708 that oppose the fin attachment portion 31*f* have shapes that extend along the outer surface 31*h* of the fin attachment portion 31*f*. Each of the radiating fins 705 and 706 is in planar contact with the outer surface 31*h* of the fin attachment portion 31*f*. Likewise, each of the radiating fins 707 and 708 is in planar contact with the outer surface 31*i* of the fin attachment portion 31*g*. Thermal conduction efficiency across the respective radiating fins 705 to 708 and the steering mechanism housing portion 31*b* is thereby made high.

The respective radiating fins 705 to 708 are preferably formed of a material containing, for example, aluminum. As shown in FIG. 10 and FIG. 11, the radiating fin 705, the radiating fin 706, the radiating fin 707, and the radiating fin 708 respectively include pluralities of radiating plates 705*a*, radiating plates 706*a*, radiating plates 707*a*, and radiating plates 708*a* that are arranged in parallel or substantially in parallel across intervals. The radiating fins 705 and 707 are arranged such that the respective radiating plates 705*a* and 706*a* extend generally vertically. Also, the radiating fins 706 and 708 are arranged such that the respective radiating plates 707*a* and 708*a* extend forward and rearward.

Also, as shown in FIG. 10, the radiating fin 705 includes a groove 705*c* provided in the opposing surface 705*b*. Likewise, as shown in FIG. 10 and FIG. 11, the radiating fin 706, the radiating fin 707, and the radiating fin 708 respectively include a groove 706*c* provided in the opposing surface 706*b*, a groove 707*c* provided in the opposing surface 707*b*, and a groove 708*c* provided in the opposing surface 708*b*. As shown in FIG. 10 the groove 705*c* interacts with the outer surface 31*h* of the fin attachment portion 31*f* to define a water flow passage 709*a*. Likewise, the groove 706*c* interacts with the outer surface 31*h* of the fin attachment portion 31*f* to define a water flow passage 709*b*. Also, as shown in FIG. 11, the groove 707*c* interacts with the outer surface 31*i* of the fin attachment portion 31*g* to define a water flow passage 709*c*. Likewise, the groove 708*c* interacts with the outer surface 31*i* of the fin attachment portion 31*g* to define a water flow passage 709*d*. The branch pipe 703*d* (see FIG. 9) is arranged such that the water flowing in the inside thereof is supplied to the respective water flow passages 709*a*, 709*b*, 709*c*, and 709*d*. Each of the water flow passages 709*a*, 709*b*, 709*c*, and 709*d* is an example of a "first water flow passage" according to a preferred embodiment of the present invention.

Next, the respective water flow passages 709*a*, 709*b*, 709*c*, and 709*d* and arrangements related thereto shall now be described.

Figure 12:
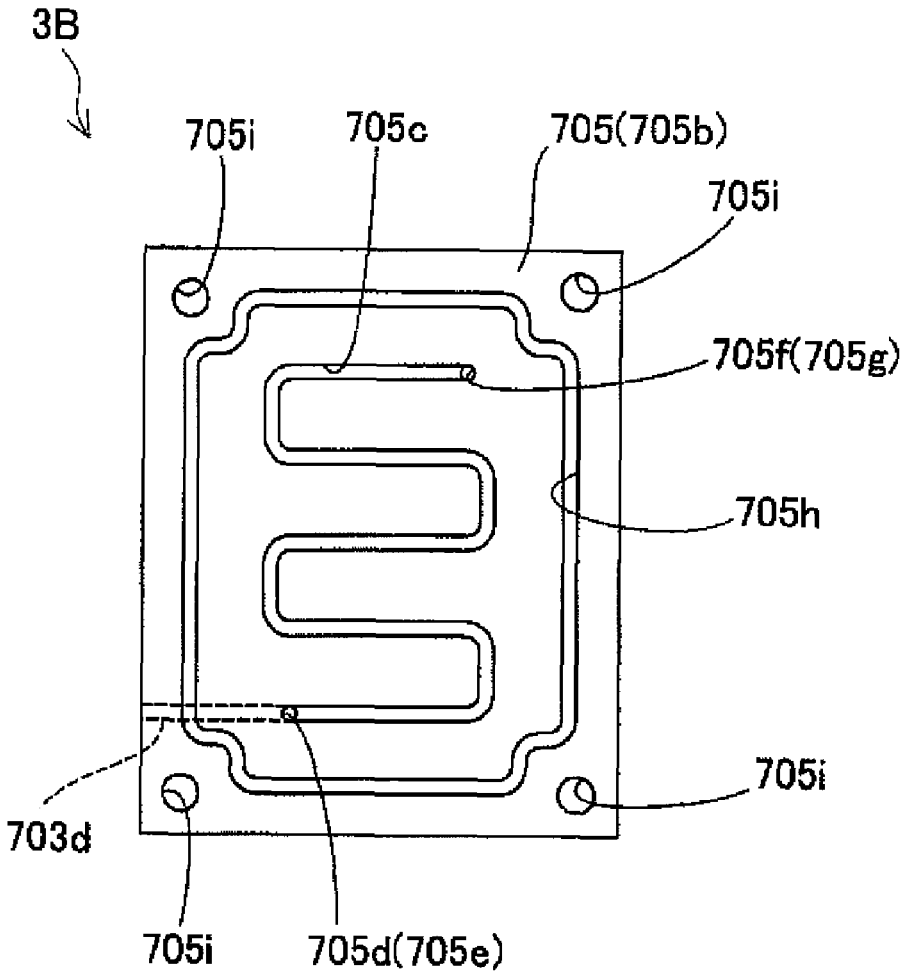
FIG. 12 is a diagram for explaining an arrangement of a radiating fin according to the second preferred embodiment of the present invention.

As shown in FIG. 10 and FIG. 11, across section (cross section perpendicular or substantially perpendicular to a longitudinal direction) of each of the grooves 705*c*, 706*c*, 707*c*, and 708*c* is, for example, semicircular. As shown in FIG. 10, the grooves 705*c* and 706*c* are covered by the outer surface 31*h* of the fin attachment portion 31*f*. Likewise, as shown in FIG. 11, the grooves 707*c* and 708*c* are covered by the outer surface 31*i* of the fin attachment portion 31*g*. As shown in FIG. 12, the groove 705*c* is arranged to meander across a wide range of the opposing surface 705*b*. Although not shown, the groove 706*c*, the groove 707*c*, and the groove 708*c* are also arranged to meander across wide ranges of the opposing surface 706*b*, the opposing surface 707*b*, and the opposing surface 708*b*, respectively.

Also, as shown in FIG. 12, the radiating fin 705 includes a connection hole 705*e* in communication with a starting point 705*d* of the groove 705*c*, and a discharge hole 705*g* in communication with an ending point 705*f* of the groove 705*c*. The branch pipe 703*d* is connected to the connection hole 705*e*. Water flowing in the branch pipe 703*d* is supplied to the water flow passage 709*a* through the connection hole 705*e*. Also, the water supplied to the water flow passage 709*a* from the connection hole 705*e* flows along an inner wall surface of the groove 705*c* and the outer surface 31*h* of the fin attachment portion 31*f* and is discharged from the discharge hole 705*g*. The radiating fin 705 and the swivel bracket 31 are thereby cooled by the water. Although not shown, each of the radiating fin 706, the radiating fin 707, and the radiating fin 708 includes a groove starting point, a groove ending point, a connection hole, and a discharge hole, in likewise manner as the radiating fin 705.

Also, as shown in FIG. 12, the radiating fin 705 includes a sealing groove 705*h* arranged to surround the groove 705*c* at the opposing surface 705*b*, and a plurality of attachment holes 705*i* arranged to penetrate through the radiating fin 705. A plurality of bolts (not shown), for example, are respectively inserted into the plurality of attachment holes 705*i*. The radiating fin 705 is detachably attached to the swivel bracket 31 by the plurality of bolts (not shown). Also, as shown in FIG. 10, an O-ring 710*a* is arranged in the sealing groove 705*h*. The O-ring 710*a* is sandwiched by the radiating fin 705 and the swivel bracket 31. Leakage of water from between the radiating fin 705 and the swivel bracket 31 is thereby prevented.

Although not shown, each of the radiating fin 706, the radiating fin 707, and the radiating fin 708 includes a sealing groove, and attachment holes, in likewise manner as the radiating fin 705. As shown in FIG. 10, the radiating fin 706 is attached to the swivel bracket 31 in a state in which an O-ring 710*b* is arranged in a sealing groove 706*h*. Also, as shown in FIG. 11, the radiating fin 707 is attached to the swivel bracket 31 in a state in which an O-ring 710*c* is arranged in a sealing groove 707*h*. Likewise, the radiating fin 708 is attached to the swivel bracket 31 in a state in which an O-ring 710*d* is arranged in a sealing groove 708*h*. Leakage of water from between the radiating fin 706, the radiating fin 707, and the radiating fin 708 and the swivel bracket 31 is thereby prevented.

Other structures of the second preferred embodiment are preferably the same or substantially the same as those of the first preferred embodiment.

Examples of technical effects and merits of the outboard motor 3B according to the second preferred embodiment of the present invention shall now be described.

With the second preferred embodiment, the outboard motor 3B includes the water flow passages 709*a*, 709*b*, 709*c*, and 709*d* that are thermally connected to the motor 313 and the driver 314. The respective water flow passages 709*a*, 709*b*, 709*c*, and 709*d* are preferably arranged along the swivel bracket 31 at the outside of the swivel bracket 31. The water flowing through the respective water flow passages 709*a*, 709*b*, 709*c*, and 709*d* thus flows along the swivel bracket 31. The swivel bracket 31 is thereby cooled by the water. The swivel bracket 31 itself and the inside of the swivel bracket 31 are thus cooled further. The structural elements arranged inside of the swivel bracket 31, such as the motor 313, the driver 314, etc., are thereby cooled efficiently.

Also, with the second preferred embodiment, the respective water flow passages 709*a*, 709*b*, 709*c*, and 709*d* are defined by mutually opposing portions of the swivel bracket 31 and the respective radiating fins 705 to 708. Specifically, grooves are provided in the opposing surfaces 705*b*, 706*b*, 707*b*, and 708*b* of the respective radiating fins 705 to 708. The opposing surfaces 705*b*, 706*b*, 707*b*, and 708*b* of the respective radiating fins 705 to 708 in which the grooves are provided are covered by the swivel bracket 31. The respective water flow passages 709*a*, 709*b*, 709*c*, and 709*d* are thereby defined. Processing of the respective radiating fins 705 to 708 is thus easy in comparison to a case where the respective water flow passages 709*a*, 709*b*, 709*c*, and 709*d* are formed, for example, by a drilling process in which holes are formed inside of the swivel bracket 31 or the respective radiating fins 705 to 708.

Also, with the second preferred embodiment, the outboard motor 3B includes the water pump 702*a* arranged to supply water to the engine 702 and the respective water flow passages 709*a*, 709*b*, 709*c*, and 709*d*. There is thus no need to separately provide an equipment (for example, a motor and a pump) arranged to supply water to the engine 702 and an equipment (for example, a motor and a pump) arranged to supply water to the respective water flow passages 709*a*, 709*b*, 709*c*, and 709*d*. An increase in the number of components of the outboard motor 3B is thereby prevented or minimized. Also, the outboard motor ordinarily includes a water pump arranged to supply cooling water to the engine and there is thus no need to provide another water pump. Increase of cost of the outboard motor 3B is thereby prevented or minimized.

Also, with the second preferred embodiment, the outboard motor 3B includes the branch pipe 703*d* connected to the respective water flow passages 709*a*, 709*b*, 709*c*, and 709*d* and the water pump 702*a*, and the flow regulating valve 704 interposed in the branch pipe 703*d*. The supply flow rate of water to the respective water flow passages 709*a*, 709*b*, 709*c*, and 709*d* is thus maintained fixed by the opening degree of the flow regulating valve 704 being fixed. The swivel bracket 31 is thereby cooled by water with stability. Also, the supply flow rate of water to the respective water flow passages 709*a*, 709*b*, 709*c*, and 709*d* is increased or decreased by regulation of the opening degree of the flow regulating valve 704. Specifically, for example, in a case where there is a large temperature difference between the swivel bracket 31, cooled by water, and the ambient air, the supply flow rate of water to the respective water flow passages 709*a*, 709*b*, 709*c*, and 709*d* is decreased. Occurrence of dew condensation inside of the swivel bracket 31 caused by temperature difference is thereby prevented. The motor 313 and the driver 314 are thereby prevented from getting wet.

Third Preferred Embodiment

Next, an outboard motor 3C according to a third preferred embodiment of the present invention shall now be described with reference to FIG. 13 to FIG. 19.

Figure 13:
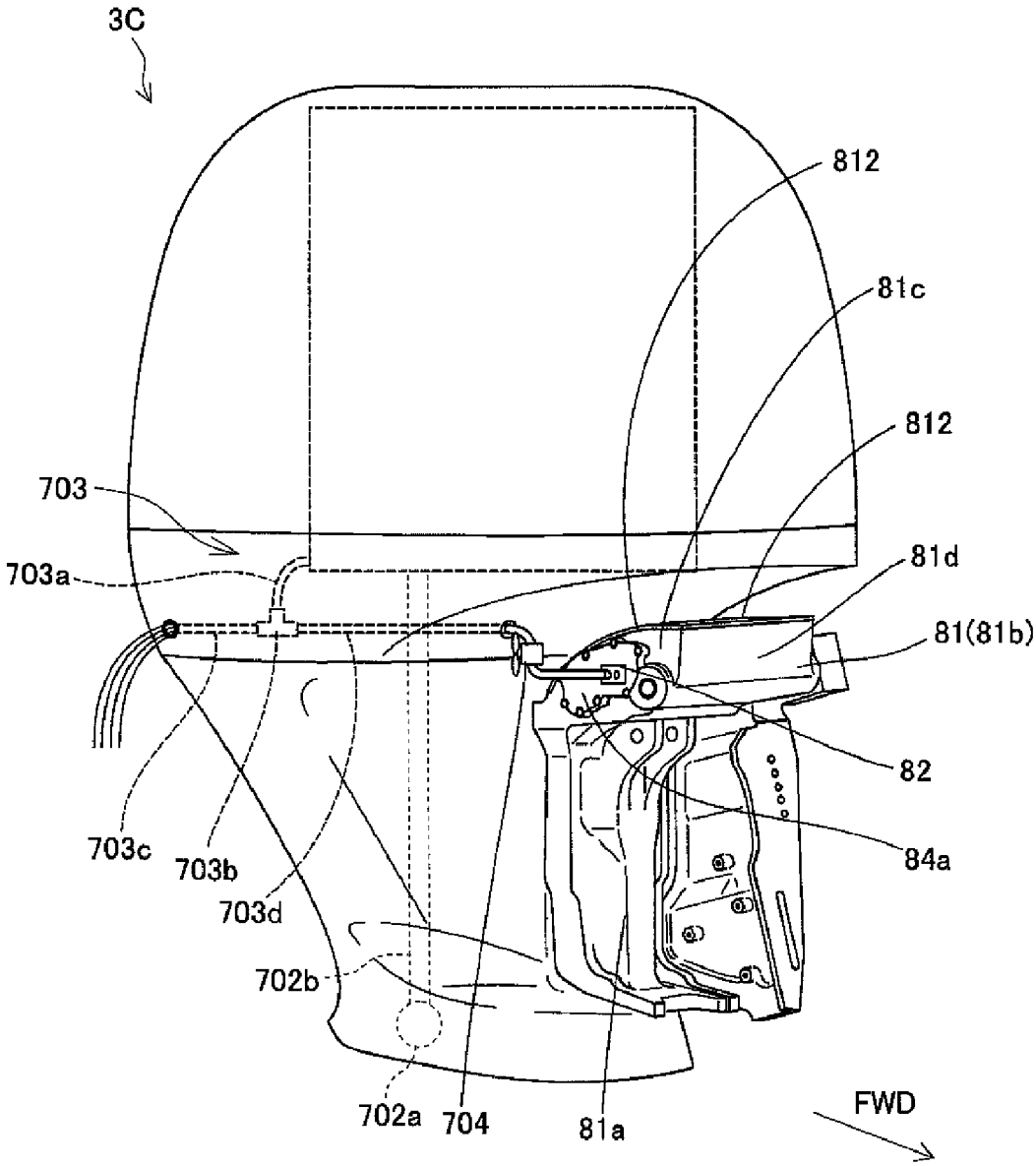
FIG. 13 is a perspective view of an outboard motor according to a third preferred embodiment of the present invention as viewed obliquely from the front.

As shown in FIG. 13, a swivel bracket 81 includes a swivel shaft holding portion 81*a*, and a steering mechanism housing portion 81*b*. The steering mechanism housing portion 81*b* is coupled to an upper portion of the swivel shaft holding portion 81*a*. The steering mechanism housing portion 81*b* is arranged to protrude forward (in a FWD arrow direction) from the upper portion of the swivel shaft holding portion 81*a*. The steering mechanism housing portion 81*b* preferably has a generally cubic shape that is opened at an upper portion and a rear portion. A cover 812 is attached to the upper portion of the steering mechanism housing portion 81*b*. The cover 812 covers an entirety of the opening of the steering mechanism housing portion 81*b*.

Figure 14:
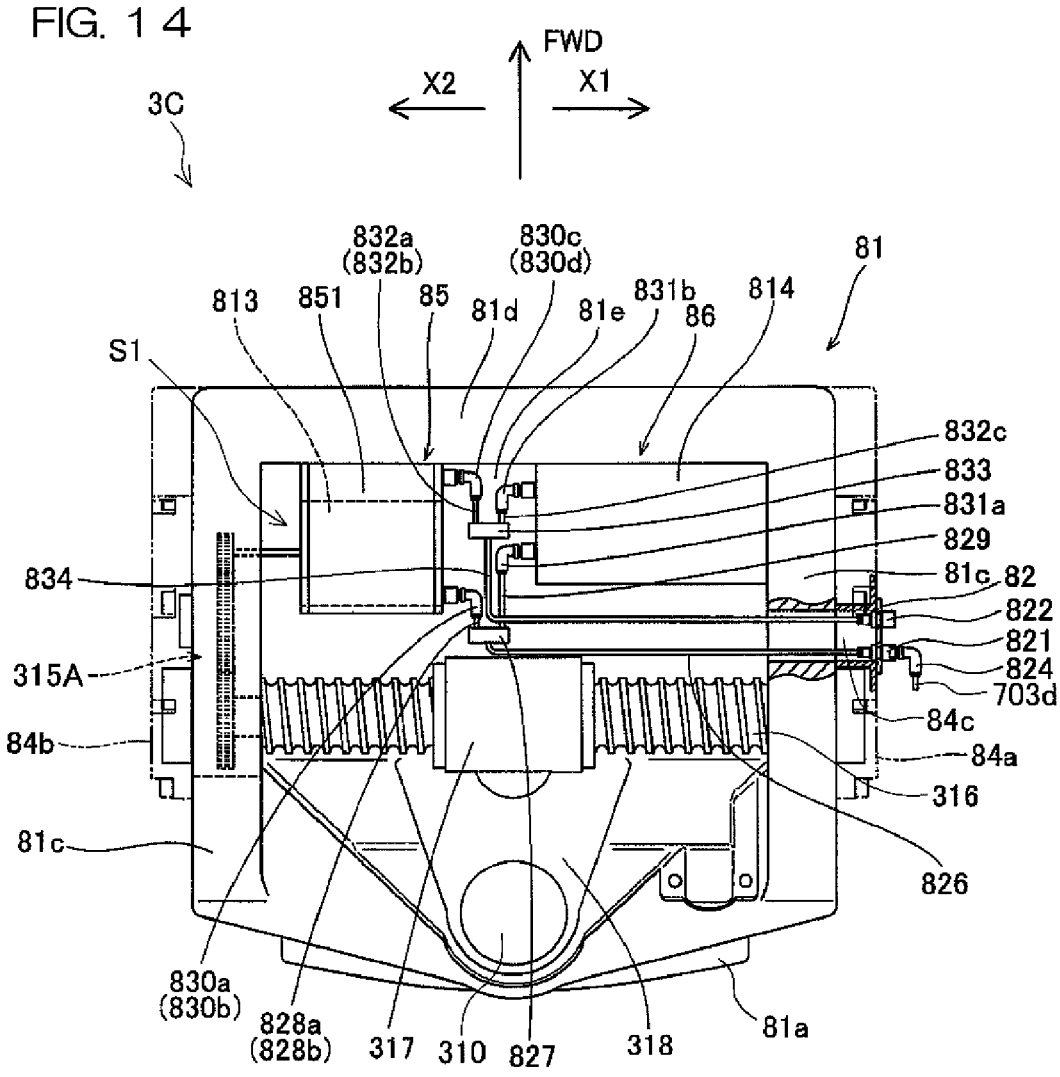
FIG. 14 is a plan view for explaining an arrangement of a swivel bracket according to the third preferred embodiment of the present invention.

Also, as shown in FIG. 14, the steering mechanism housing portion 81*b* includes a pair of side wall portions 81*c* arranged to extend forward and rearward, a front wall portion 81*d* coupling front end portions of the pair of side wall portions 81*c*, and a bottom portion 81*e* coupling lower portions of the pair of side wall portions 81*c*. The pair of side wall portions 81*c* are arranged in parallel or substantially in parallel across an interval in the width direction (X1 arrow direction and X2 arrow direction) of the hull 2. Also, the pair of side wall portions 81*c* are arranged between two plates 84*a* and 84*b*. Each of the plate 84*a* and plate 84*b* is detachably attached, for example, by a plurality of bolts, to an outer surface of the corresponding side wall portion 81*c*.

Also, as shown in FIG. 14, the plate 84*a* arranged at the X1 arrow direction side includes a through hole 84*c* arranged to penetrate through the plate 84*a*. The through hole 84*c* penetrates to an inside of the steering mechanism housing portion 81*b*. The through hole 84*c* is covered by a plate 82 attached to an outer surface of the plate 84*a*. Connecting members 821 and 822 are coupled to the plate 82. The branch pipe 703*d* arranged at an outside of the steering mechanism housing portion 81*b* is coupled to the connecting member 821 via an L-shaped connecting member 824 coupled to the connecting member 821. An inflow hose 826 arranged inside of the steering mechanism housing portion 81*b* is in communication with the branch pipe 703*d* via the connecting members 821 and 824. Also, an outflow hose 834 arranged inside of the steering mechanism housing portion 81*b* is coupled to the connecting member 822. Water flowing in the branch pipe 703*d* is supplied to the inflow hose 826 via the connecting members 821 and 824. The water supplied to the inflow hose 826 passes through the inside of the steering mechanism housing portion 81*b* and is discharged into the connecting member 822 from the outflow hose 84.

Figure 15:
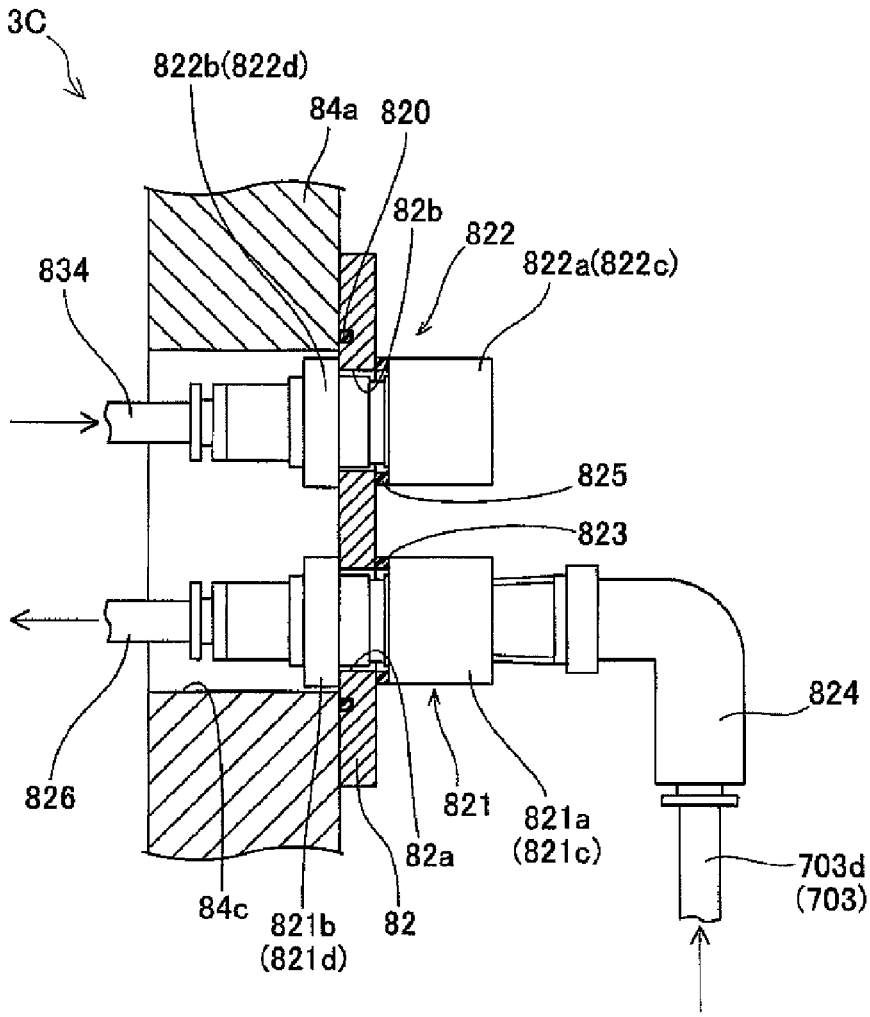
FIG. 15 is a sectional view for explaining a connecting member and an arrangement related thereto according to the third preferred embodiment of the present invention.

As shown in FIG. 15, the plate 82 has a smaller thickness than the plate 84*a*. An interval between the plate 84*a* and the plate 82 is sealed by a seal 820. The plate 82 includes two attachment holes 82*a* and 82*b* in which the connecting members 821 and 822 are inserted respectively. The connecting member 821 includes an outer connecting member 821*a* inserted from an outer side into the attachment hole 82*a*, and an inner connecting member 821*b* inserted from an inner side into the attachment hole 82*a*. Likewise, the connecting member 822 includes an outer connecting member 822*a* inserted from an outer side into the attachment hole 82*b*, and an inner connecting member 822*b* inserted from an inner side into the attachment hole 82*b*.

As shown in FIG. 15, the outer connecting member 821*a* and the inner connecting member 821*b* are coupled such that the plate 82 is sandwiched by a main body portion 821*c* of the outer connecting member 821*a* and a flange portion 821*d* of the inner connecting member 821*b*. The connecting member 821 is thereby coupled to the plate 82. An interval between the outer connecting member 821*a* and an outer surface of the plate 82 is sealed by a seal 823. Also, the outer connecting member 822*a* and the inner connecting member 822*b* are coupled such that the plate 82 is sandwiched by a main body portion 822*c* of the outer connecting member 822*a* and a flange portion 822*d* of the inner connecting member 822*b*. The connecting member 822 is thereby coupled to the plate 82. An interval between the outer connecting member 822*a* and the outer surface of the plate 82 is sealed by a seal 825.

Also, as shown in FIG. 14, the inflow hose 826 is coupled to a joint 827 arranged inside of the steering mechanism housing portion 81*b*. Hoses 828*a* and 828*b*, which are arranged inside of the steering mechanism housing portion 81*b* in a vertically overlapping manner, are coupled to the joint 827. Further, the hoses 828*a* and 828*b* are coupled to a motor cooling member 85 respectively via connecting members 830*a* and 830*b* that are arranged in a vertically overlapping manner. Also, a hose 829 arranged inside of the steering mechanism housing portion 81*b* is coupled to the joint 827. The hose 829 is coupled to a driver cooling member 86 via a connecting member 831*a*.

The motor cooling member 85 and the driver cooling member 86 are respectively an example of a "first attachment member" and an example of a "second attachment member" according to a preferred embodiment of the present invention. As shown in FIG. 14, the motor cooling member 85 and the driver cooling member 86 are respectively attached to a motor 813 and a driver 814. The motor cooling member 85 and the driver cooling member 86 are arranged across an interval in the width direction of the hull 2 inside of the steering mechanism housing portion 81*b*. The motor cooling member 85 is arranged at the side of one side wall portion 81*c* and the driver cooling member 86 is arranged at the side of the other side wall portion 81*c*.

Also, as shown in FIG. 14, the outflow hose 834 is coupled to a joint 833 arranged inside of the steering mechanism housing portion 81*b*. Hoses 832*a* and 832*b*, which are arranged inside of the steering mechanism housing portion 81*b* in a vertically overlapping manner, are coupled to the joint 833. Further, the hoses 832*a* and 832*b* are coupled to the motor cooling member 85 respectively via connecting members 830*c* and 830*d* that are arranged in a vertically overlapping manner. Also, a hose 832*c* arranged inside of the steering mechanism housing portion 81*b* is coupled to the joint 833. The hose 832*c* is coupled to the driver cooling member 86 via a connecting member 831*b*.

The water supplied to the inflow hose 826 is branched into three, for example, by the joint 827. Then, the water branched into three by the joint 827 is supplied to the hoses 828*a*, 828*b*, and 829, respectively. The water supplied to the hoses 828*a* and 828*b* is supplied to the motor cooling member 85. Also, the water supplied to the hose 829 is supplied to the driver cooling member 86. The water supplied to the motor cooling member 85 passes through an inside of the motor cooling member 85 and is thereafter discharged into the outflow hose 834 via the hoses 832*a* and 832*b* and the joint 833. Also, the water supplied to the driver cooling member 86 passes through an inside of the driver cooling member 86 and is thereafter discharged into the outflow hose 834 via the hose 832*c* and the joint 833.

The motor cooling member 85 shall now be described.

Figure 16:
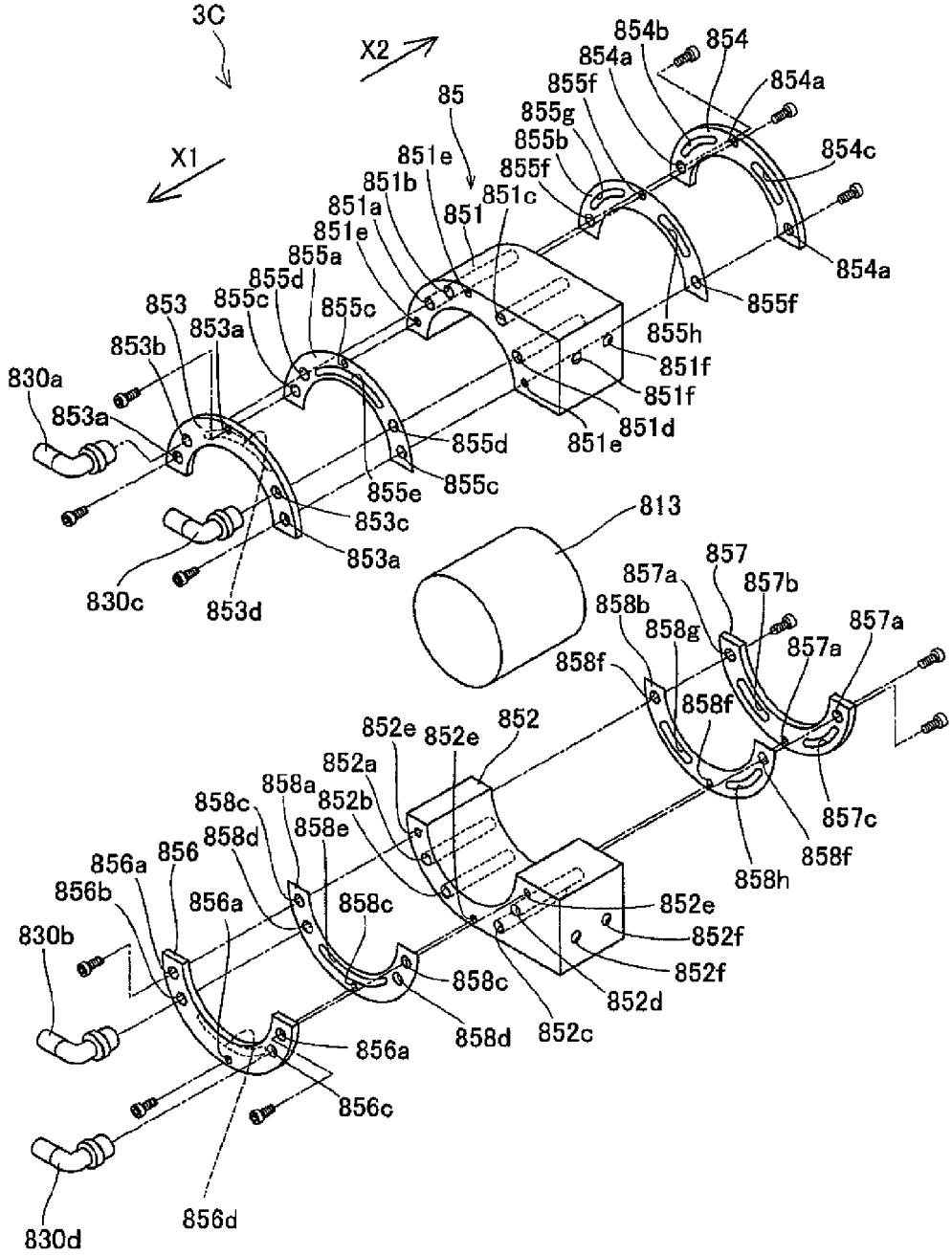
FIG. 16 is an exploded perspective view for explaining an arrangement of a motor cooling member according to the third preferred embodiment of the present invention.
Figure 17:
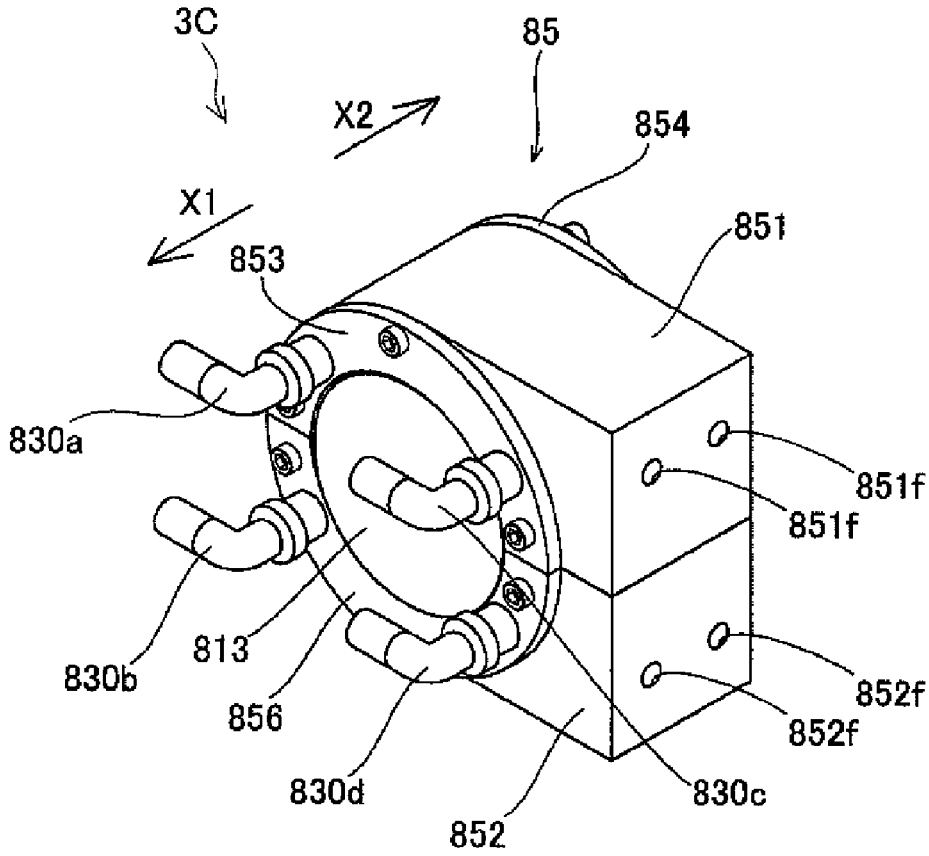
FIG. 17 is a perspective view for explaining the arrangement of the motor cooling member according to the third preferred embodiment of the present invention.

As shown in FIG. 16 and FIG. 17, the motor cooling member 85 includes an upper jacket 851 and a lower jacket 852 arranged to vertically sandwich and hold the motor 813. As shown in FIG. 16, the motor cooling member 85 includes upper plates 853 and 854 arranged at respective sides of the upper jacket 851, and upper packings 855*a* and 855*b* arranged between the upper plates 853 and 854 and the upper jacket

851. Also, the motor cooling member 85 includes lower plates 856 and 857 arranged at respective sides of the lower jacket 852, and lower packings 858*a* and 858*b* arranged between the lower plates 856 and 857 and the lower jacket 852. The connecting members 830*a* and 830*c* are coupled to the upper jacket 851. Also, the connecting members 830*b* and 830*d* are coupled to the lower jacket 852.

As shown in FIG. 16, the upper jacket 851 includes four water flow passages 851*a*, 851*b*, 851*c*, and 851*d* arranged to extend in the width direction of the hull 2. Each of the water flow passages 851*a*, 851*b*, 851*c*, and 851*d* is arranged to penetrate through the upper jacket 851 in the width direction of the hull 2. The motor cooling member 85 is arranged such that water supplied from the connecting member 830*a* flows through the respective water flow passages 851*a*, 851*b*, 851*c*, and 851*d*. Also, the upper jacket 851 includes three threaded holes 851*e* provided at an X1 arrow direction side surface of the upper jacket 851, and three threaded holes (not shown) provided at an X2 arrow direction side surface of the upper jacket 851. Further, the upper jacket 851 includes two threaded holes 851*f* for attaching the upper jacket 851 to the swivel bracket 81.

Also, the upper plate 853 arranged at the X1 arrow direction side of the upper jacket 851 includes three screw insertion holes 853*a*, holes 853*b* and 853*c*, and a groove 853*d*. The three screw insertion holes 853*a* are respectively provided at positions corresponding to the three threaded holes 851*e* of the upper jacket 851. Also, the holes 853*b* and 853*c* are respectively provided at positions corresponding to the water flow passages 851*a* and 851*d* of the upper jacket 851. The connecting member 830*a* is connected to the hole 853*b*. Also, the connecting member 830*c* is connected to the hole 853*c*. Also, the groove 853*d* is provided at a position corresponding to the water flow passages 851*b* and 851*c* of the upper jacket 851. The groove 853*d* is arranged to put the water flow passages 851*b* and 851*c* in communication.

Also, the upper packing 855*a* arranged at the X1 arrow direction side of the upper jacket 851 includes three screw insertion holes 855*a*, two holes 855*d*, and a slot 855*e*. The three screw insertion holes 855*c* are respectively provided at positions corresponding to the three threaded holes 851*e* of the upper jacket 851. Also, the two holes 855*d* are provided at positions corresponding to the water flow passages 851*a* and 851*d* of the upper jacket 851. Also, the slot 855*e* is provided at a position corresponding to the water flow passages 851*b* and 851*c* of the upper jacket 851. The slot 855*e* is arranged to put the water flow passages 851*b* and 851*c* in communication. Leakage of water from between the upper plate 853 and the upper jacket 851 is prevented by the upper packing 855*a*.

Also, the upper plate 854 arranged at the X2 arrow direction side of the upper jacket 851 includes three screw insertion holes 854*a* and grooves 854*b* and 854*c*. The three screw insertion holes 854*a* are respectively provided at positions corresponding to the three threaded holes (not shown) provided in the X2 arrow direction side surface of the upper jacket 851. Also, the groove 854*b* is provided at a position corresponding to the water flow passages 851*a* and 851*b* of the upper jacket 851. The groove 854*b* is arranged to put the water flow passages 851*a* and 851*b* in communication. Also, the groove 854*c* is provided at a position corresponding to the water flow passages 851*c* and 851*d* of the upper jacket 851. The groove 854*c* is arranged to put the water flow passages 851*c* and 851*d* in communication.

Also, the upper packing 855*b* arranged at the X1 arrow direction side of the upper jacket 851 includes three screw insertion holes 855*f*, and slots 855*g* and 855*h*. The three screw insertion holes 855*f* are respectively provided at positions corresponding to the three threaded holes (not shown) provided in the X2 arrow direction side surface of the upper jacket 851. Also, the slot 855*g* is provided at a position corresponding to the water flow passages 851*a* and 851*b* of the upper jacket 851. The slot 855*g* is arranged to put the water flow passages 851*a* and 851*b* in communication. Also, the slot 855*h* is provided at a position corresponding to the water flow passages 851*c* and 851*d* of the upper jacket 851. The slot 855*h* is arranged to put the water flow passages 851*c* and 851*d* in communication. Leakage of water from between the upper plate 854 and the upper jacket 851 is prevented by the upper packing 855*b*.

Meanwhile, as shown in FIG. 16, the lower jacket 852 includes four water flow passages 852*a*, 852*b*, 852*c*, and 852*d* arranged to extend in the width direction of the hull 2. Each of the water flow passages 852*a*, 852*b*, 852*c*, and 852*d* is arranged to penetrate through the lower jacket 852 in the width direction of the hull 2. The motor cooling member 85 is arranged such that water supplied from the connecting member 830*b* flows through the respective water flow passages 852*a*, 852*b*, 852*c*, and 852*d*. Also, the lower jacket 852 includes three threaded holes 852*e* provided at an X1 arrow direction side surface of the lower jacket 852, and three threaded holes (not shown) provided at an X2 arrow direction side surface of the lower jacket 852. Further, the lower jacket 852 includes two threaded holes 852*f* for attaching the lower jacket 852 to the swivel bracket 81.

Also, the lower plate 856 arranged at the X1 arrow direction side of the lower jacket 852 includes three screw insertion holes 856*a*, holes 856*b* and 856*c*, and a groove 856*d*. The three screw insertion holes 856*a* are respectively provided at positions corresponding to the three threaded holes 852*e* of the lower jacket 852. Also, the holes 856*b* and 856*c* are respectively provided at positions corresponding to the water flow passages 852*a* and 852*d* of the lower jacket 852. The connecting member 830*b* is connected to the hole 856*b*. The connecting member 830*d* is connected to the hole 856*c*. Also, the groove 856*d* is provided at a position corresponding to the water flow passages 852*b* and 852*c* of the lower jacket 852. The groove 856*d* is arranged to put the water flow passages 852*b* and 852*c* in communication.

Also, the lower packing 858*a* arranged at the X1 arrow direction side of the lower jacket 852 includes three screw insertion holes 858*c*, two holes 858*d*, and a slot 858*e*. The three screw insertion holes 858*c* are respectively provided at positions corresponding to the three threaded holes 852*e* of the lower jacket 852. Also, the two holes 858*d* are provided at positions corresponding to the water flow passages 852*a* and 852*d* of the lower jacket 852, respectively. Also, the slot 858*e* is provided at a position corresponding to the water flow passages 852*b* and 852*c* of the lower jacket 852. The slot 858*e* is arranged to put the water flow passages 852*b* and 852*c* in communication. Leakage of water from between the lower plate 856 and the lower jacket 852 is prevented by the lower packing 858*a*.

Also, the lower plate 857 arranged at the X2 arrow direction side of the lower jacket 852 includes three screw insertion holes 857*a* and grooves 857*b* and 857*c*. The three screw insertion holes 857*a* are respectively provided at positions corresponding to the three threaded holes (not shown) provided in the X2 arrow direction side surface of the lower jacket 852. Also, the groove 857*b* is provided at a position corresponding to the water flow passages 852*a* and 852*b* of the lower jacket 852. The groove 857*b* is arranged to put the water flow passages 852*a* and 852*b* in communication. Also, the groove 857*c* is provided at a position corresponding to the water flow passages 852*c* and 852*d* of the lower jacket 852.

The groove 857*c* is arranged to put the water flow passages 852*c* and 852*d* in communication.

Also, the lower packing 858*b* arranged at the X1 arrow direction side of the lower jacket 852 includes three screw insertion holes 858*f*, and slots 858*g* and 858*h*. The three screw insertion holes 858*f* are respectively provided at positions corresponding to the three threaded holes (not shown) provided in the X2 arrow direction side surface of the lower jacket 852. Also, the slot 858*g* is provided at a position corresponding to the water flow passages 852*a* and 852*b* of the lower jacket 852. The slot 858*g* is arranged to put the water flow passages 852*a* and 852*b* in communication. Also, the slot 858*h* is provided at a position corresponding to the water flow passages 852*c* and 852*d* of the lower jacket 852. The slot 858*h* is arranged to put the water flow passages 852*c* and 852*d* in communication. Leakage of water from between the lower plate 857 and the lower jacket 852 is prevented by the lower packing 858*b*.

The motor cooling member 85 thus includes a water flow passage connecting the connecting member 830*a* and the connecting member 830*c*, and a water flow passage connecting the connecting member 830*b* and the connecting member 830*d*. That is, the motor cooling member 85 includes a second water flow passage provided inside of the motor cooling member 85. The water supplied to the motor cooling member 85 from the connecting member 830*a* thus passes through the inside of the motor cooling member 85 and is thereafter discharged from the connecting member 830*c*. Likewise, the water supplied to the motor cooling member 85 from the connecting member 830*b* passes through the inside of the motor cooling member 85 and is thereafter discharged from the connecting member 830*d*. The motor cooling member 85 is thereby cooled by water. The motor 813 coupled to the motor cooling member 85 is thus cooled by the motor cooling member 85.

The driver cooling member 86 shall now be described.

Figure 18:
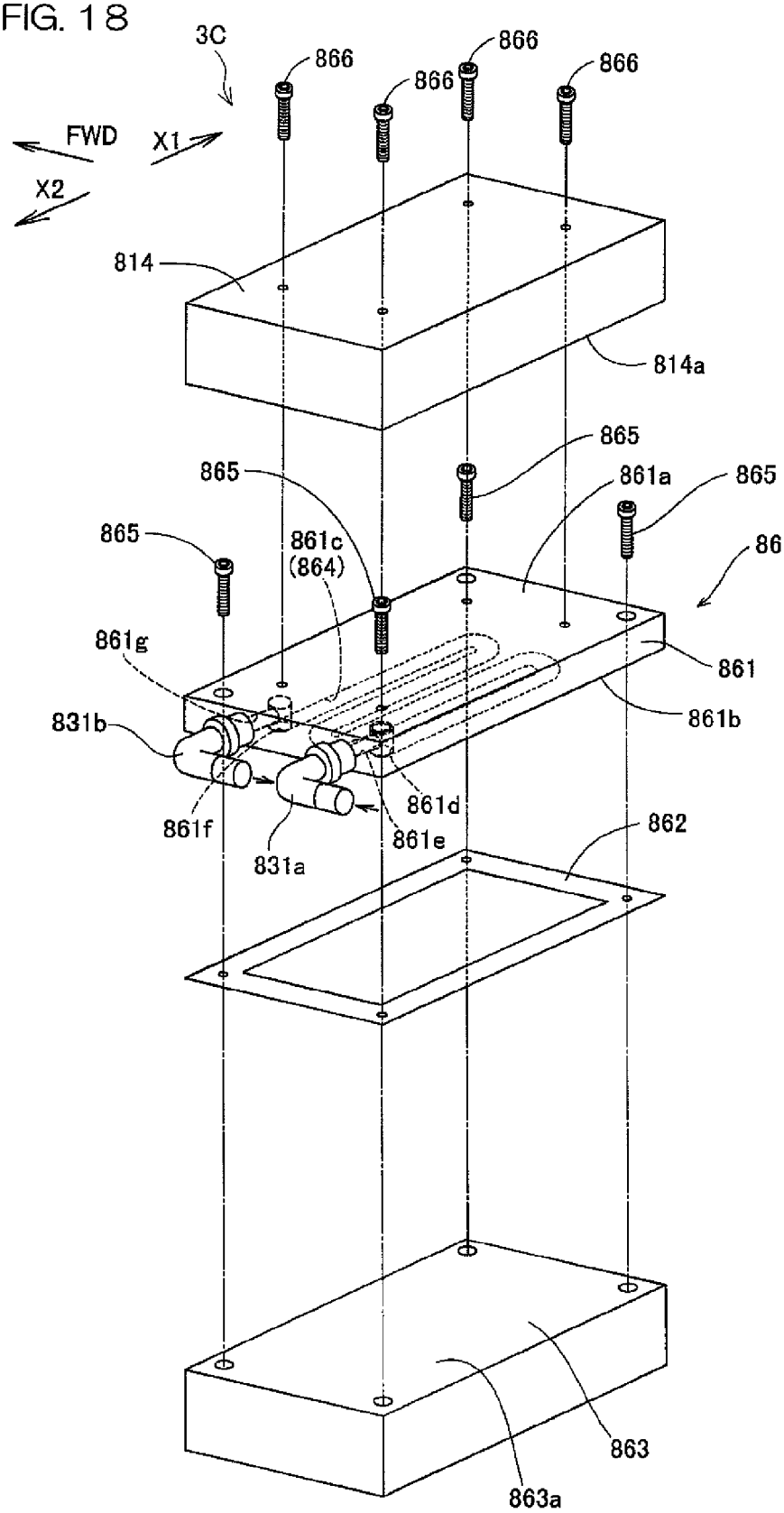
FIG. 18 is an exploded perspective view for explaining an arrangement of a driver cooling member according to the third preferred embodiment of the present invention.
Figure 19:
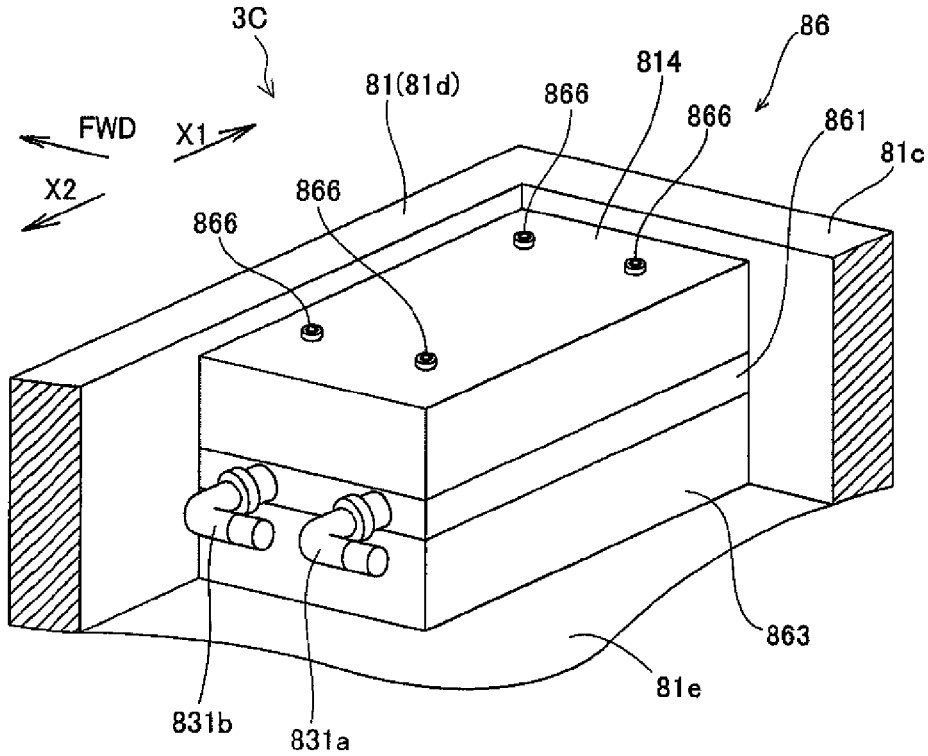
FIG. 19 is a perspective view for explaining the arrangement of the driver cooling member according to the third preferred embodiment of the present invention.

As shown in FIG. 18, the driver cooling member 86 includes a jacket 861 arranged below the driver 814, a packing 862 arranged below the jacket 861, and a supporting portion 863 arranged to support the packing 862. The jacket 861 is fixed along with the packing 862 to the supporting portion 863 by four screws 865. The packing 862 is sandwiched by the jacket 861 and the supporting portion 863. Also, the driver 814 is fixed to the jacket 861 by four screws 866, for example. The connecting members 831*a* and 831*b* are coupled to the jacket 861. The supporting portion 863 has, for example, a block-shaped configuration. As shown in FIG. 19, the supporting portion 863 is, for example, a portion of the bottom portion 81*e* of the swivel bracket 81.

Also, the jacket 861 is preferably formed of a material containing, for example, aluminum. As shown in FIG. 18, the jacket 861 is, for example, a flat, plate-shaped member. The jacket 861 is arranged horizontally. The jacket 861 includes an upper surface 861*a* arranged to be of a shape and size corresponding to a bottom surface 814*a* of the driver 814, and a bottom surface 861*b* in which a groove 861*c* is provided. The bottom surface 814*a* of the driver 814 is in planar contact with the upper surface 861*a* of the jacket 861. Thermal conduction efficiency between the driver 814 and the jacket 861 is thereby made high. Also, the groove 861*c* provided in the bottom surface 861*b* of the jacket 861 is covered by an upper surface 863*a* of the supporting portion 863. An inner wall surface of the groove 861*c* interacts with the upper surface 863*a* of the supporting portion 863 to define a water flow passage 864.

As shown in FIG. 18, the groove 861*c* is arranged to meander across a wide range of the bottom surface 861*b* of the jacket 861. The jacket 861 includes a connection hole 861*e* in communication with a starting point 861*d* of the groove 861*c*, and a connection hole 861*g* in communication with an ending point 861*f* of the groove 861*c*. The connecting member 831*a* is put in communication with the starting point 861*d* of the groove 861*c* via the connection hole 861*e*. Also, the connecting member 831*b* is put in communication with the ending point 861*f* of the groove 861*c* via the connection hole 861*g*. The driver cooling member 86 includes a second water flow passage that connects the connecting member 831*a* and the connecting member 831*b*. Water supplied to the water flow passage 864 from the connecting member 831*a* flows along the inner wall surface of the groove 861*c* and the upper surface 863*a* of the supporting portion 863 and is thereafter discharged into the connecting member 831*b*. The driver cooling member 86 and the supporting portion 863 are thereby cooled by the water. The driver 814 coupled to the driver cooling member 86 is thus cooled by the driver cooling member 86. Also, leakage of water from between the jacket 861 and the supporting portion 863 is prevented because the packing 862 is sandwiched by the jacket 861 and the supporting portion 863.

Other structures of the third preferred embodiment are preferably the same or substantially the same as those of the second preferred embodiment.

Examples of technical effects and merits of the outboard motor 3C according to the third preferred embodiment of the present invention shall now be described.

With the third preferred embodiment, the outboard motor 3C includes the motor cooling member 85 attached to the motor 813, and the driver cooling member 86 attached to the driver 814. The motor cooling member 85 includes the second water flow passage provided inside of the motor cooling member 85. Likewise, the driver cooling member 86 includes the second water flow passage provided inside of the driver cooling member 86. The motor cooling member 85 and the driver cooling member 86 are cooled by the water flowing through the second water flow passages. The motor 813 and the driver 814 are thus cooled respectively by the motor cooling member 85 and the driver cooling member 86. The motor 813 and the driver 814 are thereby cooled efficiently.

Fourth Preferred Embodiment

An outboard motor 3D according to a fourth preferred embodiment of the present invention shall now be described with reference to FIG. 20 to FIG. 22.

Figure 20:
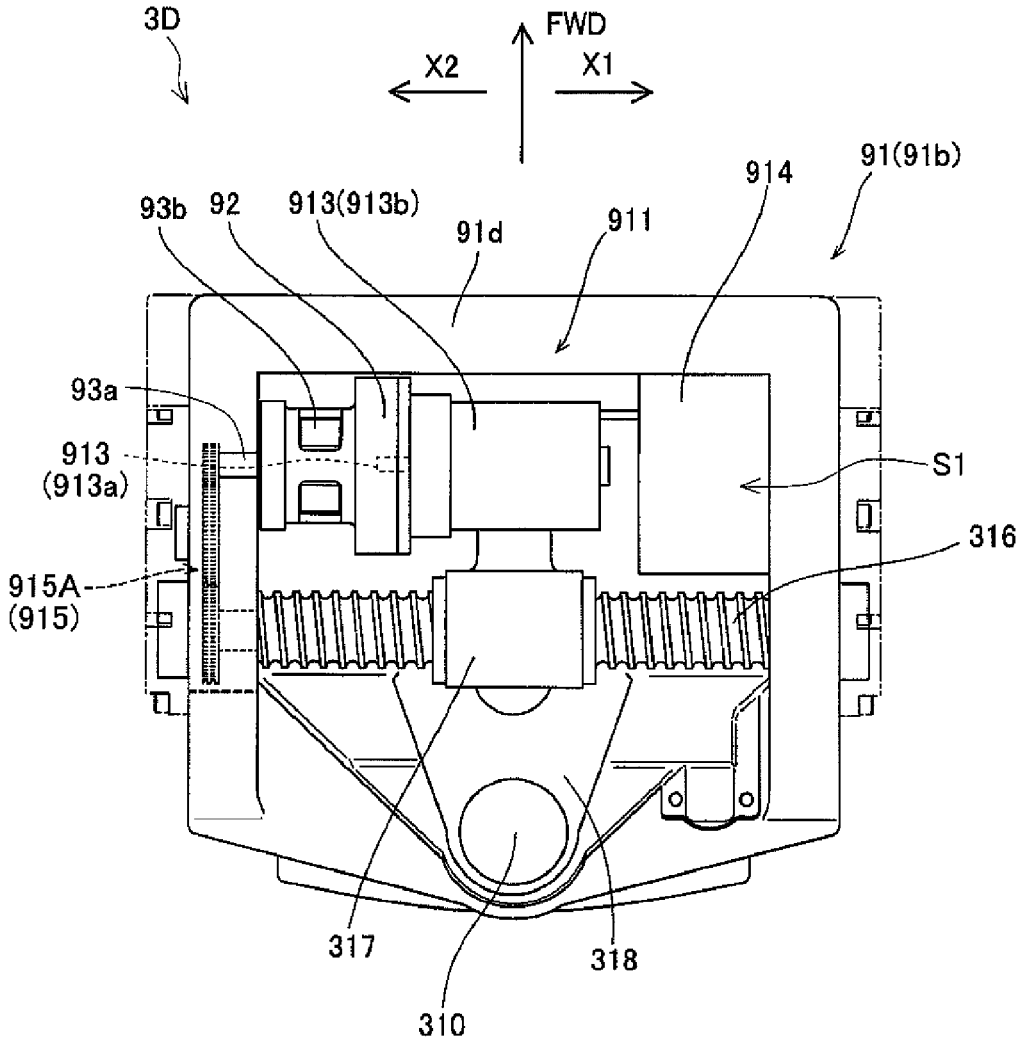
FIG. 20 is a plan view for explaining an arrangement of a swivel bracket according to a fourth preferred embodiment of the present invention.

As shown in FIG. 20, the outboard motor 3D includes a steering mechanism 911 housed inside of a steering mechanism housing portion 91*b*. The steering mechanism 911 is arranged to turn a swivel shaft 310. The steering mechanism 911 includes a motor 913, a driver 914, and a transmitting mechanism 915. The motor 913 is arranged along an inner surface of a front wall portion 91*d*. The motor 913 is driven to rotate by electricity. The motor 913 includes an output shaft 913*a* and a motor main body 913*b*. The motor 913 is arranged such that the output shaft 913*a* extends along the width direction of the hull 2. The output shaft 913*a* is arranged to protrude in the width direction of the hull 2 from the motor main body 913*b*. The motor 913 is controlled by the driver 914. The driver 914 is an example of the "control board" according to a preferred embodiment of the present invention. A driving force of the motor 913 is transmitted to the swivel shaft 310 via the transmitting mechanism 915. The transmitting mechanism 915 includes a gear mechanism 915A.

Figure 21:
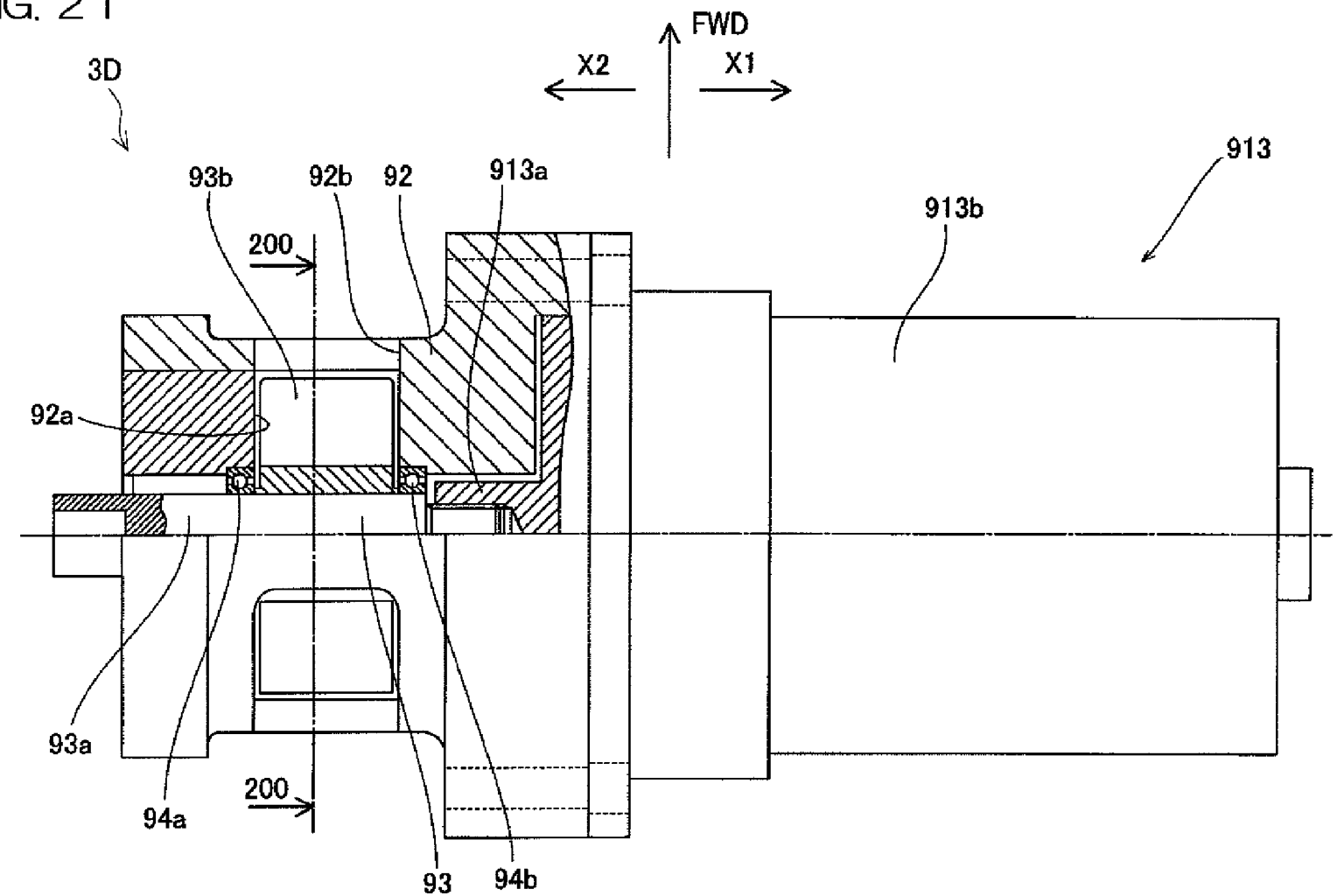
FIG. 21 is a partial sectional view for explaining an arrangement of a cooling fan according to the fourth preferred embodiment of the present invention.
Figure 22:
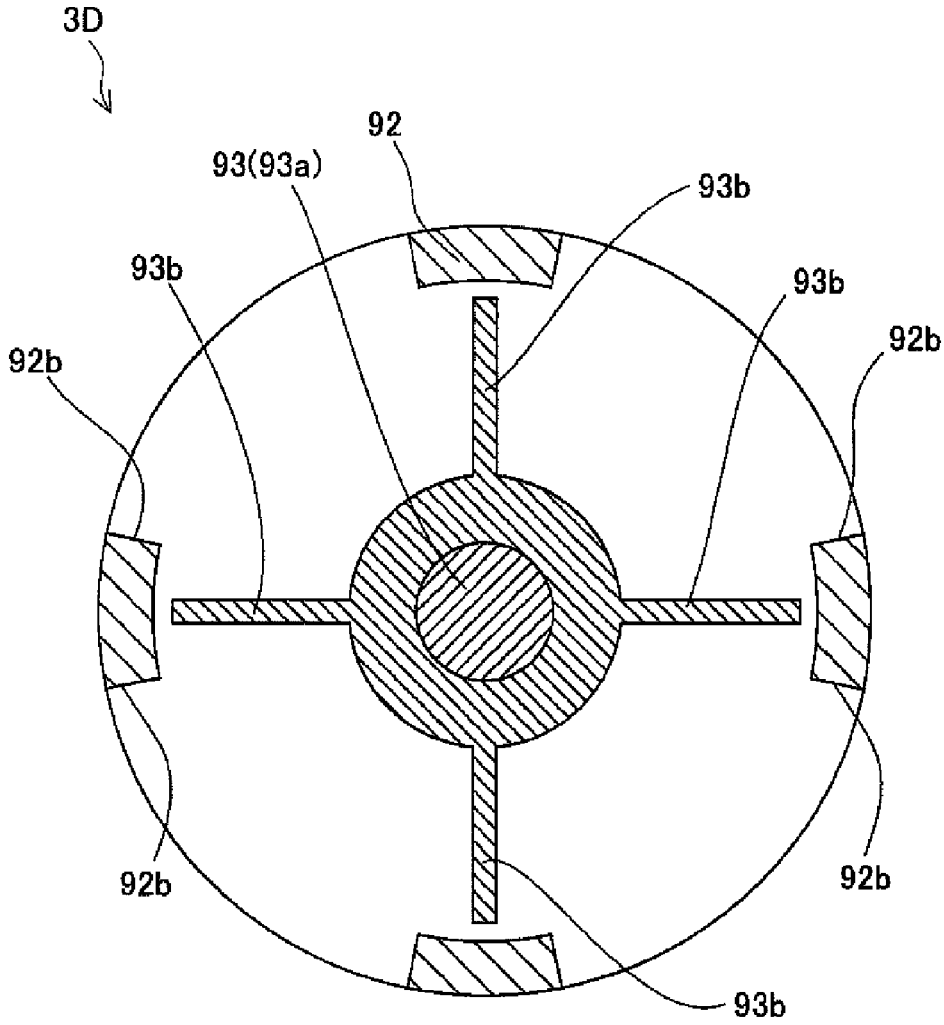
FIG. 22 is a sectional view taken on line 200-200 of FIG. 21.

Also, as shown in FIG. 21, the outboard motor 3D includes a cooling fan 93 coupled to the output shaft 913*a* of the motor 913, and a bracket 92 attached to the motor 913. The cooling fan 93 is housed inside bracket 92. The cooling fan 93 includes a rotating shaft 93*a*, and a plurality of vane portions 93*b*. As shown in FIG. 20, the gear mechanism 915A is coupled to the rotating shaft 93*a*. Also, as shown in FIG. 21, the rotating shaft 93*a* is coaxially coupled to the output shaft 913*a*. As shown in FIG. 22, the respective vane portions 93*b* are arranged to protrude in radial directions of the rotating shaft 93*a* from the rotating shaft 93*a*. The rotating shaft 93*a* and the respective vane portions 93*b* are arranged to rotate together with the output shaft 913*a*.

As shown in FIG. 21, the bracket 92 is attached to a portion at the X2 arrow direction side of the motor main body 913*b*. The bracket 92 supports the rotating shaft 93*a* via a pair of bearings 94*a* and 94*b*. The bracket 92 includes a housing portion 92*a* housing the plurality of vane portions 93*b*, and a plurality of opening portions 92*b* provided in the housing portion 92*a*. An inside of the bracket 92 is put in communication with an outside of the bracket 92 by the opening portions 92*b*. Thus, when the cooling fan 93 is rotated in accordance with the rotation of the output shaft 913*a*, an air flow is formed in a periphery of the bracket 92. The motor 913 and the driver 914 are thereby cooled by air. Also, the air inside of the steering mechanism housing portion 91*b* is stirred and the inside of the steering mechanism housing portion 91*b* is thus cooled uniformly.

Other structures of the fourth preferred embodiment are preferably the same or substantially the same as those of the first preferred embodiment.

Examples of technical effects and merits of the outboard motor 3D according to the fourth preferred embodiment of the present invention shall now be described.

With the fourth preferred embodiment, the outboard motor 3D is arranged inside the swivel bracket 91 and includes the cooling fan 93 coupled in an integrally rotatable manner to the output shaft 913*b* of the motor 913. Thus, when the output shaft 913*b* of the motor 913 is rotated, an air flow is formed inside the swivel bracket 91 by the rotation of the cooling fan 93. The motor 913 and the driver 914 are thereby cooled by air. Also, a dedicated drive source arranged to rotate the cooling fan 93 is not required because the cooling fan 93 is rotated by the motor 913 that is arranged to generate the driving force that turns the swivel shaft 310. Increase of the number of parts of the outboard motor 3*d* is thus prevented or minimized.

Fifth Preferred Embodiment

Figure 23:
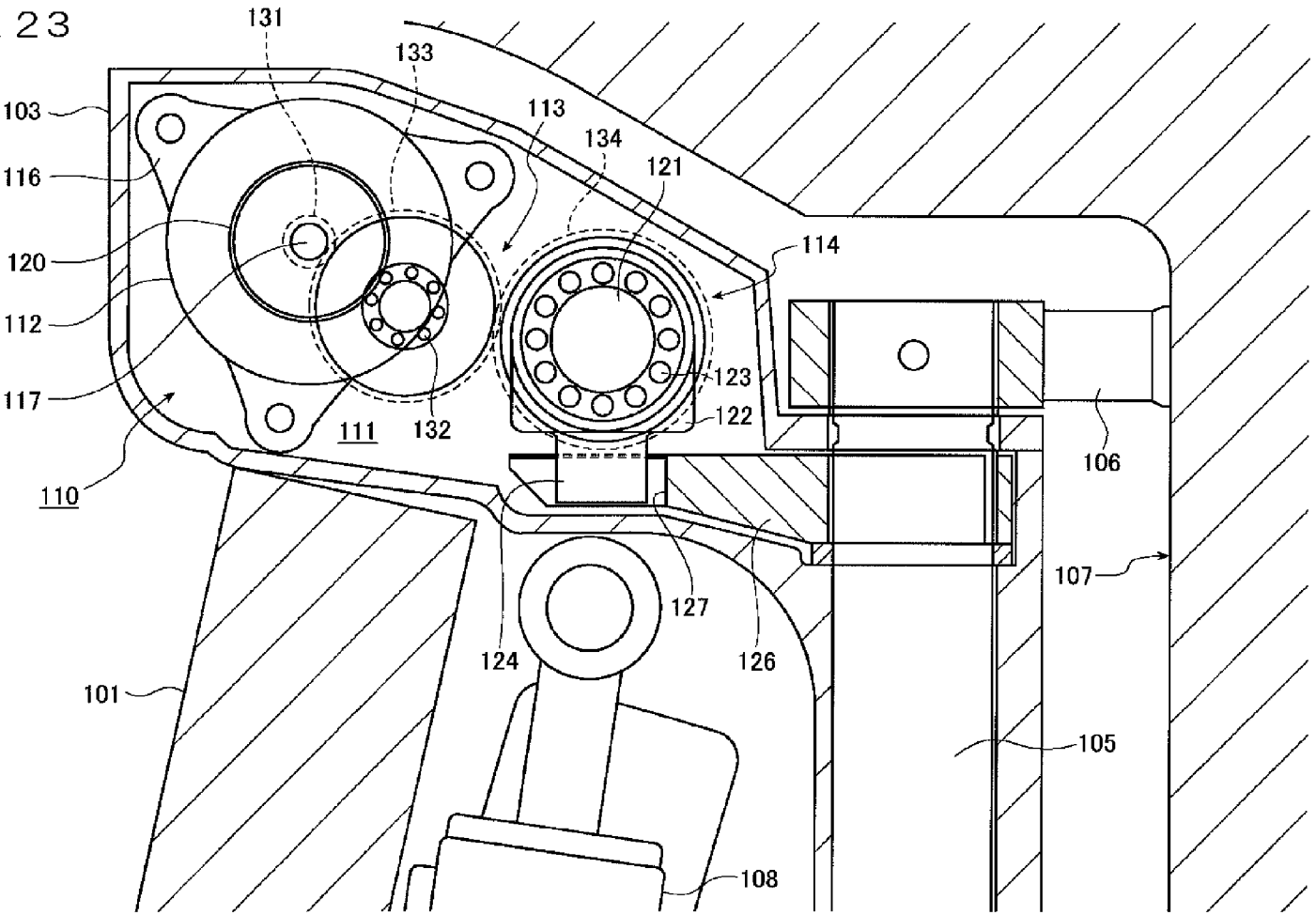
FIG. 23 is a left side view showing a steering portion of an outboard motor of an electric steering device for a watercraft in accordance with a fifth preferred embodiment of the present invention.
Figure 24:
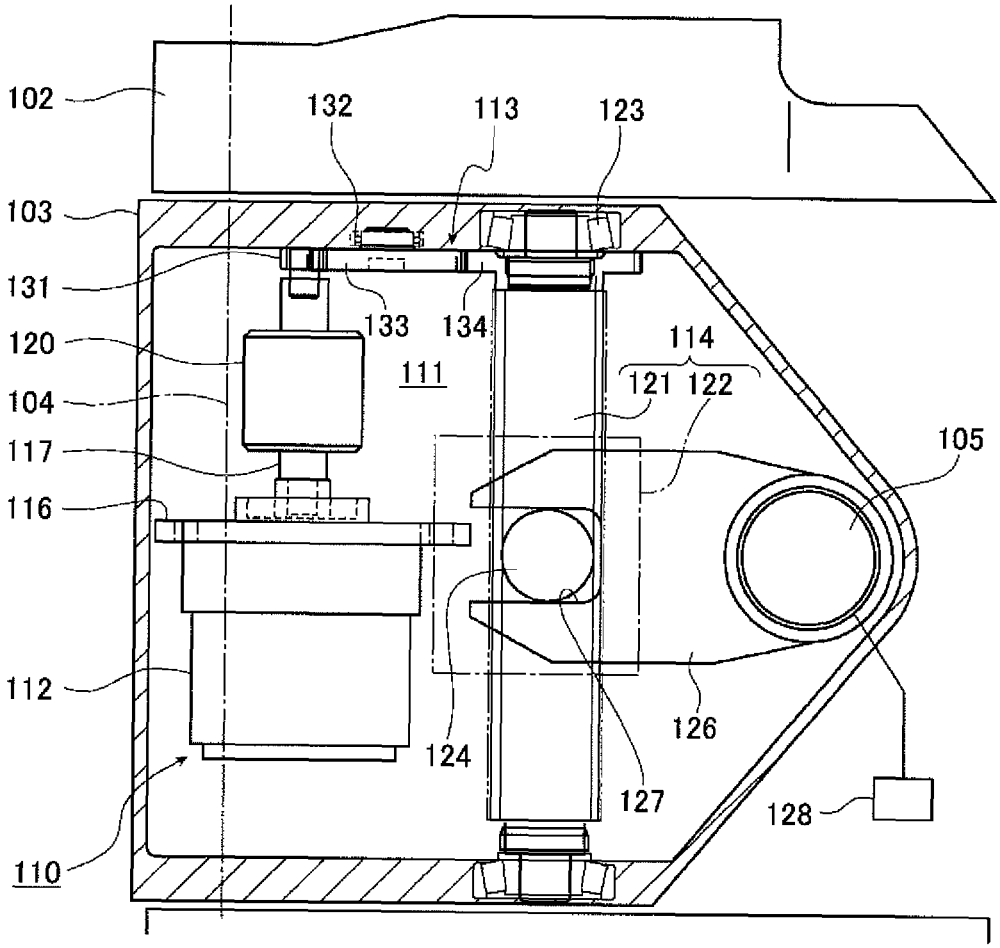
FIG. 24 is a plan view showing the steering portion of the outboard motor of the electric steering device for a watercraft in accordance with the fifth preferred embodiment of the present invention.

FIG. 23 is a left side view showing an area in the vicinity of a steering portion of an outboard motor of an electric steering device for a watercraft in accordance with a fifth preferred embodiment of the present invention. FIG. 24 is a plan view showing an area in the vicinity of the steering portion. The left sides of FIGS. 23 and 24 correspond to the traveling direction of the watercraft.

As shown in FIG. 24, a bracket clamp 102 is fixed to a transom 101 of the watercraft shown in FIG. 23. A swivel bracket 103 is coupled to the bracket clamp 102 rotatably around a horizontal supporting shaft 104 (see FIG. 24). A pivot shaft 105 is pivotally supported by the swivel bracket 103 in a rotatable manner. An outboard motor main body 107 is coupled to both the upper and lower ends of the pivot shaft 105 via coupling arms 106.

The outboard motor main body 107 can be turned to the right or the left around the pivot shaft 105 relative to the swivel bracket 103 and the transom 101, and tilted up together with the swivel bracket 103 around the horizontal supporting shaft 104. The outboard motor main body 107 and the swivel bracket 103 are tilted up by a tilting hydraulic cylinder 108. When the outboard motor main body 107 turns to the right or the left around the pivot shaft 105, the watercraft is steered.

The outboard motor main body 107 is turned to the right or the left by an electric steering device 110. The electric steering device 110 is disposed in a steering compartment 111 installed inside an upper portion of the swivel bracket 103, and transmits an output of an electric motor 112 to the pivot shaft 105 and the outboard motor main body 107 after reducing a speed of the output by using a speed reducing gear train 113 and a ball screw device 114.

The pivot shaft 105 is pivotally and substantially perpendicularly supported in a rear portion of the steering compartment 111. The electric motor 112 is fixed to a front portion of the steering compartment 111 by a fixing plate 116. An axial line of a motor shaft 117 projects along the watercraft width direction. The motor shaft 117 protrudes from a right side surface of the electric motor 112. A reverse input shutoff clutch 120 (for example, TORQUE DIODE® from NTN Corporation) which will be described in detail later, is provided on substantially the middle of the motor shaft 117.

The ball screw device 114 includes a ball screw shaft 121 and a ball nut 122. The ball screw shaft 121 is disposed between the electric motor 112 and the pivot shaft 105 with its axis arranged along the watercraft width direction, and pivotally supported by a pair of right and left bearings 123 in a rotatable manner. The motor shaft 117 of the electric motor 112 and the ball screw shaft 121 are disposed substantially parallel to each other in the watercraft width direction such that the motor shaft 117 is toward the front and the ball screw shaft 121 is toward the rear.

The ball nut 122 is engaged with the ball screw shaft 121 via a large number of steel balls (not shown). The ball screw shaft 121 rotates, and thereby the ball nut 122 smoothly moves without play in the axial direction. A slide pin 124 preferably having a short column shape is arranged to protrude from a lower surface of the ball nut 122. On the other hand, a steering arm 126 is provided in the vicinity of an upper end of the pivot shaft 105 to unitarily rotate with the pivot shaft 105. The slide pin 124 of the ball nut 122 is slidably engaged with a notch-shaped slider 127 provided at a tip of the steering arm 126 without play. A steering angle detecting sensor 128 is provided to the pivot shaft 105.

The speed reducing gear train 113 includes a drive gear 131 provided at an end of the motor shaft 117 of the electric motor 112 to unitarily rotate therewith, a middle gear 133 pivotally supported by a bearing 132 on a right inner surface of the steering compartment 111, and a driven gear 134 provided at a right end of the ball screw shaft 121 to unitarily rotate therewith, such that all of the gears are engaged together.

Rotation of the electric motor 112 (and the motor shaft 117) is transmitted to the ball screw shaft 121 with its rotational speed reduced by the speed reducing gear train 113 in two steps. The rotation of the ball screw shaft 121 is further reduced through ball screw engagement, and moves the ball nut 122 to the right or the left. The movement of the ball nut 122 is transmitted to the steering arm 126 through engagement between the slide pin 124 and the slider 127. The steering arm 126 turns, and this causes the pivot shaft 105 and the outboard motor main body 107 turn to the right or the left relative to the swivel bracket 103. Thereby, the watercraft can be steered.

Propeller reaction and/or water current cause a steering force to act on the outboard motor main body 107 and push it back to a straight traveling state while an operator counter-steers to compensate for, for example, a wind direction and/or a tidal current. The electric steering device 110 includes a steering retaining device arranged to retain a steering angle against the external steering force applied from the outside of the watercraft.

It is preferable that the steering retaining device have a simple mechanical structure. The reverse input shutoff clutch 120 provided on the motor shaft 117 of the electric motor 112 is an example of a steering retaining device in the fifth preferred embodiment. The reverse input shutoff clutch 120 is a known rotation transmitting member which is disposed in a rotational driving system. The reverse input shutoff clutch 120 does not transmit rotation from an output side (reverse driving torque) to an input side, and locks rotation although it transmits rotation from the input side (driving torque) to the output side.

It is preferable that the reverse input shutoff clutch 120 of the reverse input locking type used as the steering retaining device be disposed in substantially the middle of a rotation transmitting path between the electric motor 112 and the speed reducing device (the speed reducing gear train 113 and the ball screw device 114). Ideally, the reverse input shutoff clutch 120 should be disposed as close as possible to the electric motor 112 which is the drive source. Therefore, the reverse input shutoff clutch 120 is provided coaxially with the motor shaft 117 of the electric motor 112 in the fifth preferred embodiment.

When the electric motor 112 operates, rotation of the motor shaft 117 is transmitted to the steering arm 126 with its rotational speed reduced as described above, and the outboard motor main body 107 turns to the right or the left. The reverse input shutoff clutch 120 transmits approximately 100% of the output from the electric motor 112 to the speed reducing gear train 113 at this point.

However, a reverse driving torque causing the motor shaft 117 of the electric motor 112 to rotate in the opposite direction occurs, for example, when the steering force due to propeller reaction and/or water current pushes the outboard motor main body 107 back to a straight traveling state is applied to the outboard motor main body 107 during counter-steering. At this time, the reverse input shutoff clutch 120 locks rotation of a shaft on the output side, and locks the outboard motor main body 107 to prevent it from turning. Thereby, a steering angle is retained.

Accordingly, it is not required to keep applying a driving force of the electric motor 112 to the outboard motor main body 107 to generate a steering retaining force to retain the steering angle. Electric power supply to the electric motor 112 can be stopped, and electric power consumption can be considerably reduced.

Specifically, a controlling device (CPU or the like) arranged to control the electric motor 112 executes a real-time detection of an amount of steering by the operator of the watercraft (for example, a turning amount of a steering device) with the steering angle detecting sensor 128 or a steering sensor (not shown). If there is no change in the steering amount during a prescribed period (for example, several seconds), the controlling device determines that it is in a steering retaining state, and stops the electric power supply to the electric motor 112.

The reverse input shutoff clutch 120 which is used as the steering retaining device is a mechanical element. Therefore, it has a simple construction, and is more reliable. The reverse input shutoff clutch 120 is highly reliable for these reasons. Further, the reverse input shutoff clutch 120 does not require electric power for its operation, and thus can maintain the steering retaining force in a circumstance where electric power is not sufficiently supplied, such as during a power failure. Therefore, the concern that a steering angle becomes off a target angle due to propeller reaction and/or water current can be eliminated. The reverse input shutoff clutch 120 is highly reliable in this respect also.

Further, the reverse input shutoff clutch 120 is compact in size. Thereby, the entire electric steering device 110 can be compactly constructed with a lower cost. In particular, the reverse input shutoff clutch 120 is provided coaxially with the motor shaft 117 of the electric motor 112. Therefore, the reverse driving torque applied from the outboard motor main body 107 can be damped to a minimum by the speed reducing gear train 113 and the ball screw device 114. This allows a reduction in the torque capacity of the reverse input shutoff clutch 120 and further results in size reduction. The electric steering device 110 can be made even more compact.

The motor shaft 117 of the electric motor 112 and the ball screw shaft 121 of the ball screw device 114 are disposed next to each other in the watercraft fore-and-aft direction in a manner such that each of their axial lines is along the watercraft width direction. Accordingly, an entire arrangement of the electric steering device 110 is made compact, and thus can be disposed in the steering compartment 111 thereby effectively using space. Further, this largely contributes to the size reduction of the entire outboard motor.

Sixth Preferred Embodiment

Figure 25:
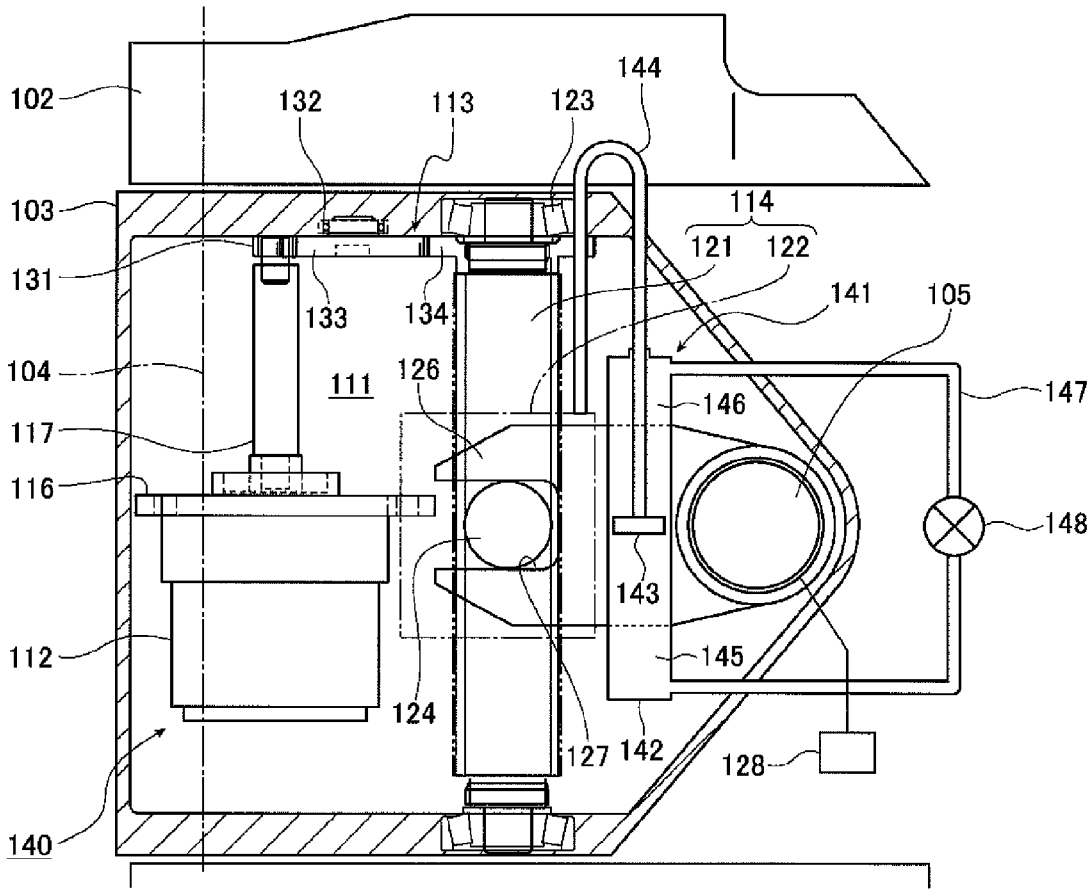
FIG. 25 is a plan view of a steering portion of an outboard motor of an electric steering device for a watercraft in accordance with a sixth preferred embodiment of the present invention.

FIG. 25 is a plan view of a vicinity of a steering portion of an outboard motor of an electric steering device for a watercraft in accordance with a sixth preferred embodiment of the present invention. In FIG. 25, the same reference numerals are given to the same features for the electric steering device shown in FIGS. 23 and 24, and descriptions thereof will be omitted.

A steering retaining device is not provided on the motor shaft 117 of the electric motor 112 in an electric steering device 140 in the present preferred embodiment. The steering retaining device is a stopper hydraulic cylinder 141 provided in a vicinity of the ball screw device 114.

In the stopper hydraulic cylinder 141, a piston 143 is slidably provided in a horizontally arranged cylinder 142. A piston rod 144 extending from the piston 143 extends outside from a right end of the horizontal cylinder 142, curves in a U-shape, and is coupled to the ball nut 122 of the ball screw device 114. The stopper hydraulic cylinder 141 has a loop path 147 connecting oil chambers 145 and 146 arranged on both sides of the piston in the horizontal cylinder 142. The oil chambers 145, 146 and the loop conduit 147 are filled with hydraulic oil. A shut-off valve 148 is provided substantially in the middle of the loop conduit 147.

When the ball nut 122 moves in the axial direction of the ball screw shaft 121 as the outboard motor main body 107 is steered, the piston 143 slides in the horizontal cylinder 142 via the piston rod 144, and thereby hydraulic oil in the oil chambers 145 and 146 flow into each other through the loop path 147. However, the hydraulic oil in the oil chambers 145 and 146 cannot flow into each other if the shut-off valve 148 is closed. Accordingly, movement of the piston 143 is locked, movement of the ball nut 122 is also locked, and thus a steering angle of the outboard motor main body 107 is retained. As described above, the stopper hydraulic cylinder 141 enters a free flowing state when the shut-off valve 148 is open, and changes to a steering retaining state when the shut-off valve 148 is closed.

Figure 26:
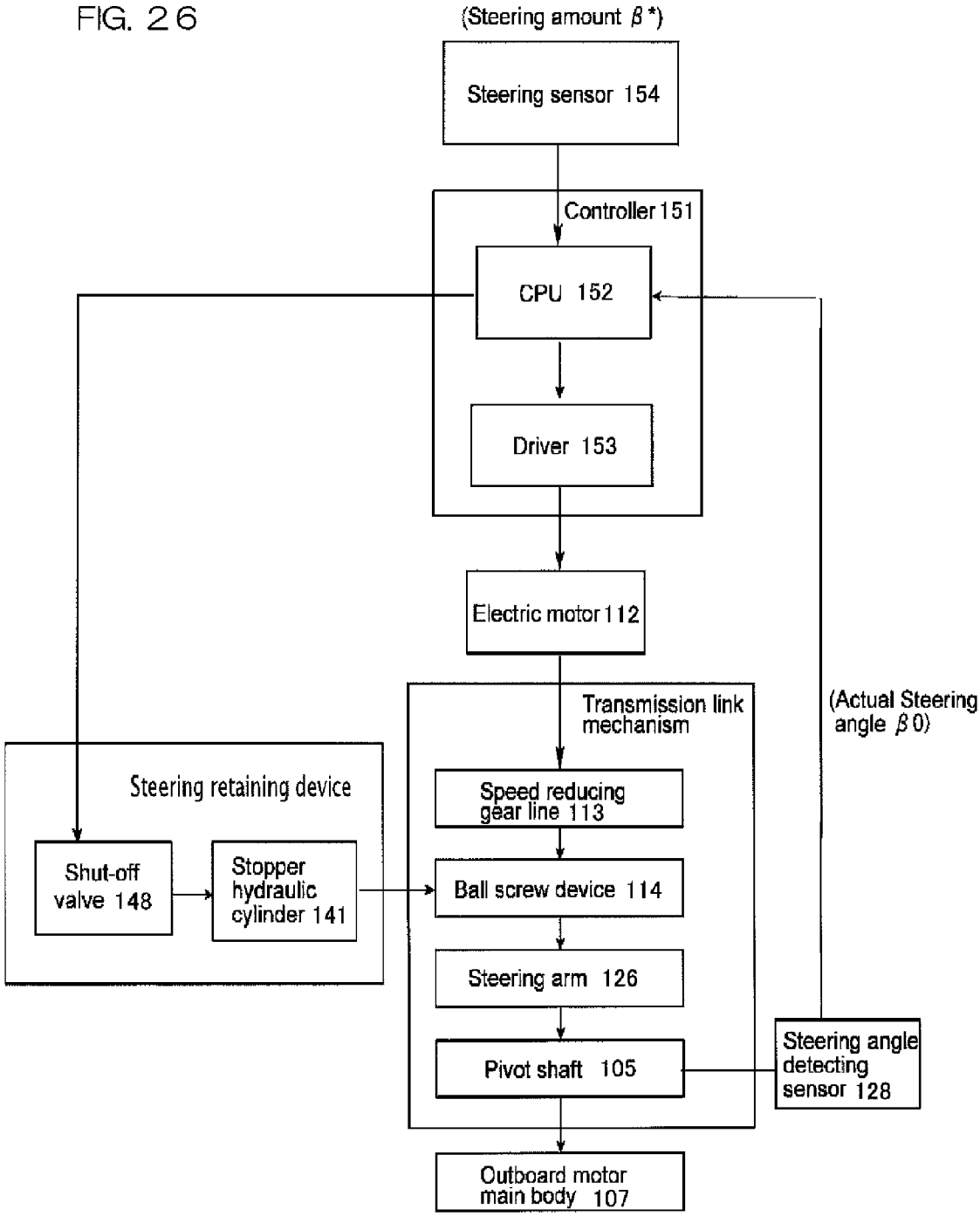
FIG. 26 is a block diagram showing a control system of a preferred embodiment of the electric steering device.

FIG. 26 is a block diagram showing a control system of the electric steering device 140. A controller 151 preferably includes a CPU 152 and a driver 153. The driver 153 receives an instruction from the CPU 152, and controls a supply voltage to the electric motor 112.

A steering sensor 154 and the steering angle detecting sensor 128 are connected to the CPU 152. A steering amount $\beta^*$ made by an operator of the watercraft is input from the steering sensor 154. An actual steering angle $\beta_0$ of the outboard motor main body 107 is input from the steering angle detecting sensor 128. The shut-off valve 148 of the stopper hydraulic cylinder 141 is electrically connected to the CPU 152, and opening or closing of the valve is controlled by the CPU 152. That is, the CPU 152 controls shifting between the steering retaining state and the free state of the stopper hydraulic cylinder 141.

The CPU 152 detects the steering retaining state that a steering angle of the outboard motor main body 107 is retained from a steering condition of the outboard motor main body 107 and an operational state of the stopper hydraulic cylinder 141, and thereby stops electric power supply to the electric motor 112.

Specifically, the CPU 152 controls the electric motor 112 via the driver 153 such that the steering amount $\beta^*$ is equal to the actual steering angle $\beta_0$ while the watercraft is traveling. In a case of counter-steering, and so forth, the CPU 152 closes the shut-off valve 148 and causes the stopper hydraulic cylinder 141 to be in the steering retaining state. Thereby, the CPU 152 retains a steering angle of the outboard motor main body 107, and at the same time stops electric power supply to the electric motor 112. Accordingly, electric power consumption of the electric motor 112 can be largely reduced.

Figure 27:
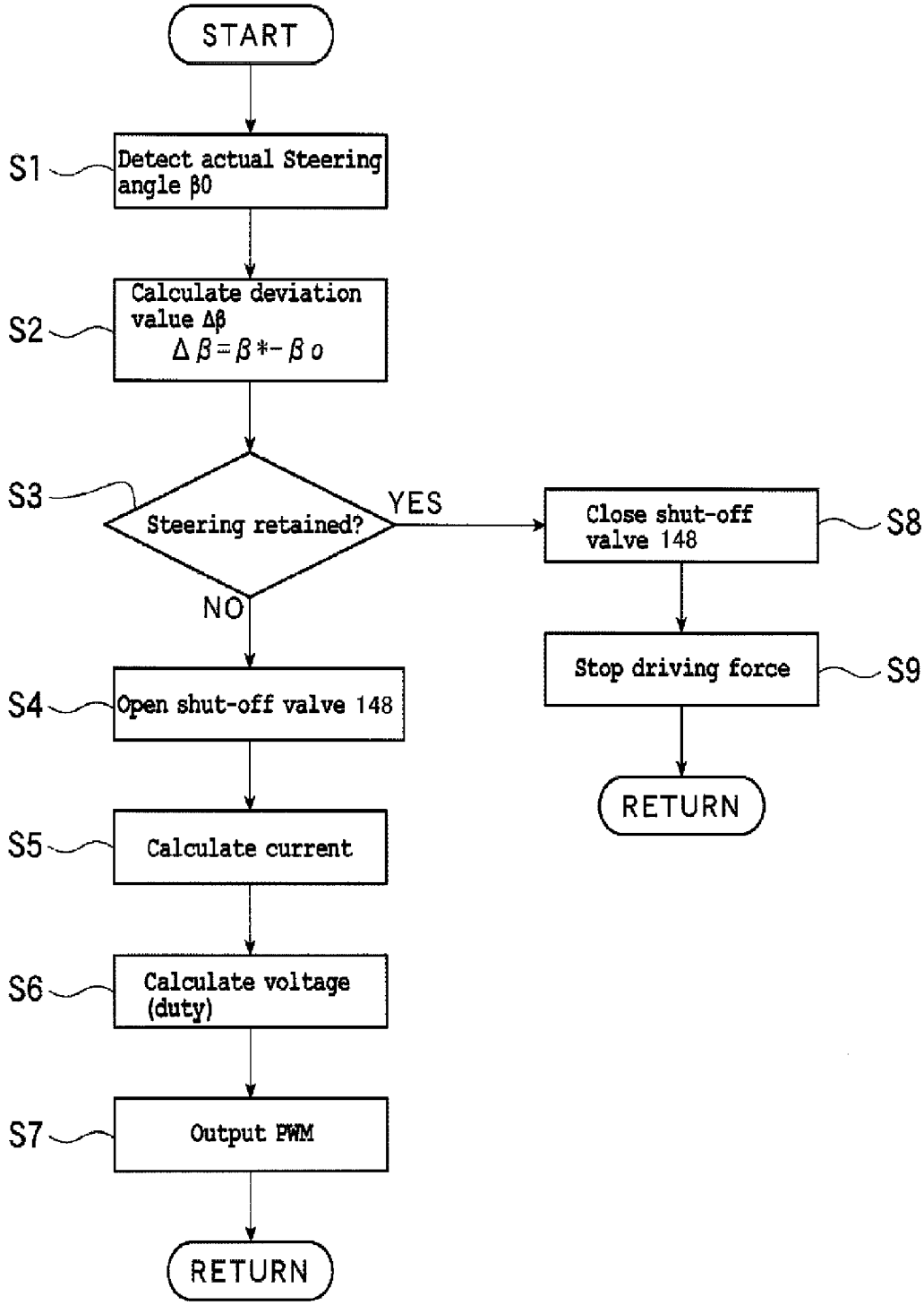
FIG. 27 is a flowchart of a control process that can be used to stop an electric power supply to an electric motor while retaining the correct steering angle.

FIG. 27 is a flowchart describing a control method. When the control method is started, the actual steering angle $\beta_0$ is detected in step S1, and a deviation value $\Delta\beta$ between the steering amount $\beta^*$ and the actual steering angle $\beta_0$ is calculated in step S2. Next, a determination is made whether the stopper hydraulic cylinder 141 is in the steering retaining state or not in step S3. If the determination is NO in step S3, opening of the shut-off valve 148, current calculation, voltage calculation, outputting PWM and so forth are executed in the following steps S4 through S7, and the electric motor 112 is operated.

On the other hand, if the determination is YES in step S3, the CPU 152 outputs an instruction to close the shut-off valve 148 in the next step S8. Further, electric power supply to the electric motor 112 is stopped in step S9, and generation of the driving force is stopped. The control method then returns to the start.

Figure 28:
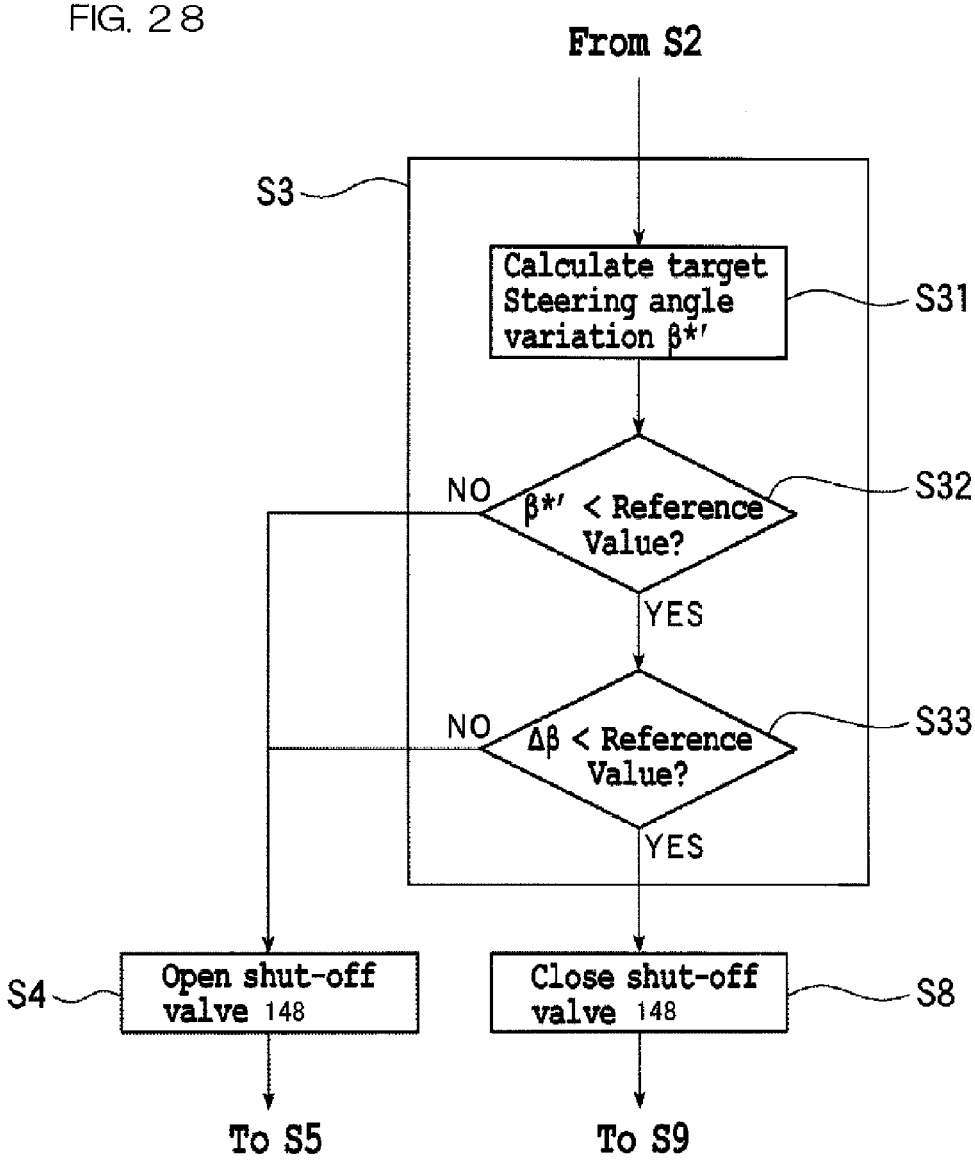
FIG. 28 is a flowchart showing the details of a determination process in step S3 shown in FIG. 27.

FIG. 28 is a flowchart showing the determination process in step S3 in detail. In step S3, a variation $\beta^{*\prime}$ in a target steering angle is calculated first in step S31. Next, a determination is made whether the variation $\beta^{*\prime}$ in a target steering angle is within a reference value or not in step S32. If the determination is YES in step S32, a determination is made whether the deviation value $\Delta\beta$ is within a reference value or not in step S33. If the determination is YES in step S33, the process progresses to step S8, and the CPU 152 outputs an instruction to close the shut-off valve 148. If the determination is NO in step S32 or step S33, the process progresses to step S4.

The CPU 152 can control the shifting between the steering retaining state and the free state of the stopper hydraulic cylinder 141 which, in the present preferred embodiment, is the steering retaining device in the electric steering device 140. Therefore, retention of a steering angle or release from the retention can be more precisely and more effectively controlled.

Figure 29A:
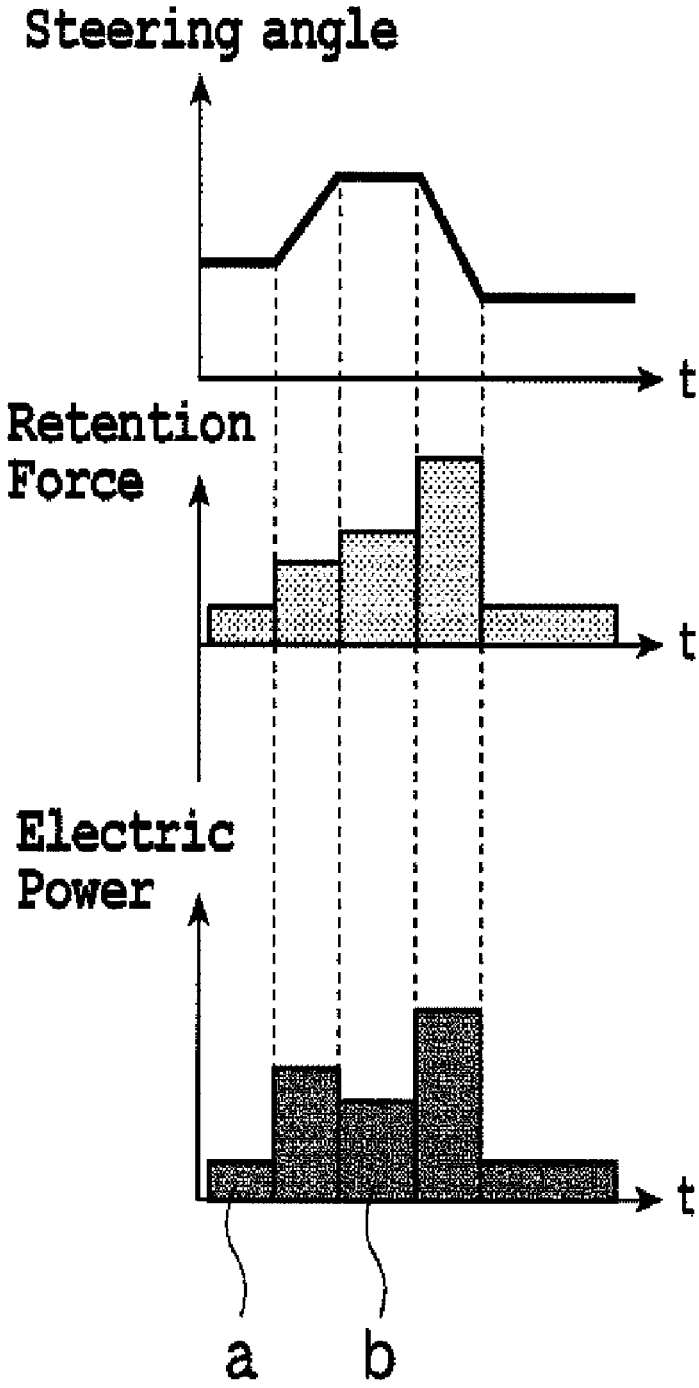
FIGS. 29A and 29B show the relationship between a steering amount and a required electric power in the conventional art and a preferred embodiment of the present invention, respectively.
Figure 29B:
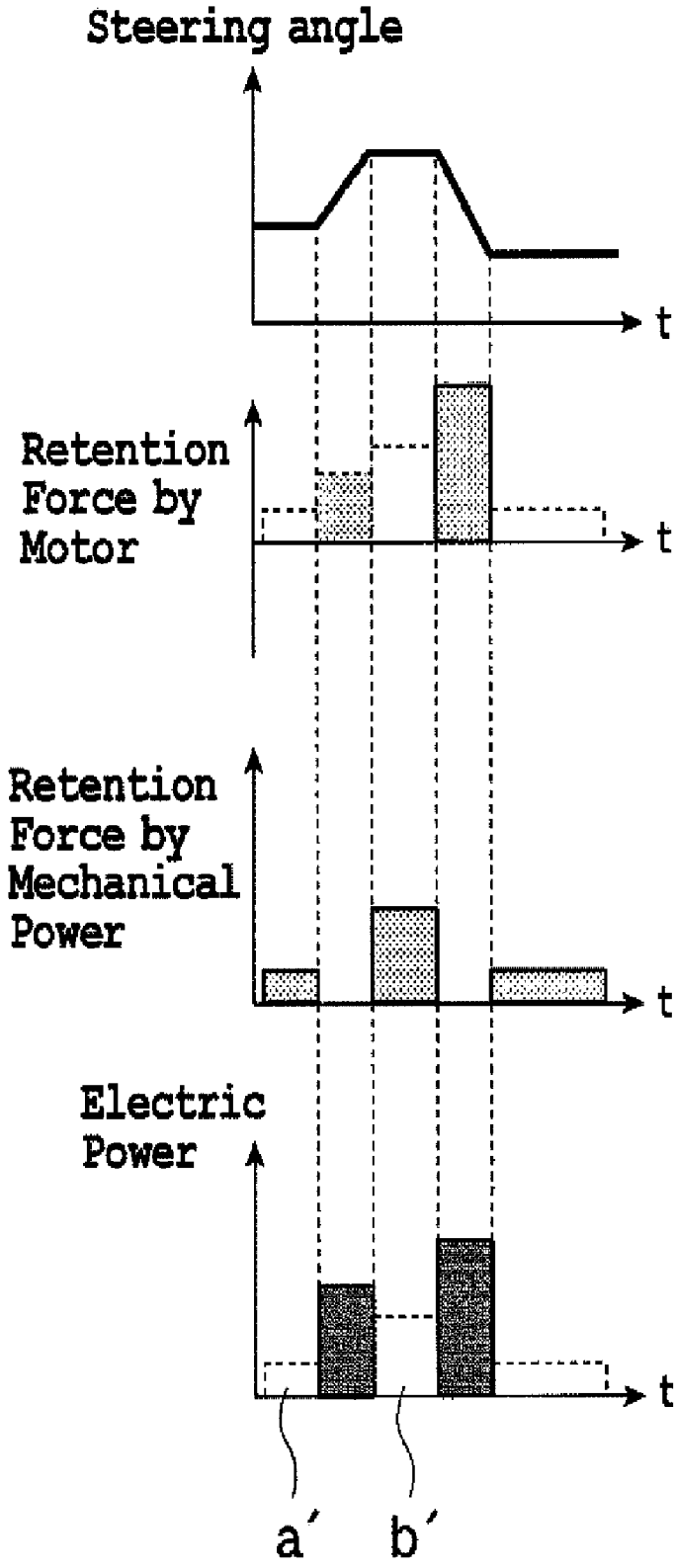

FIG. 29A is a graph indicating the relationship between a steering amount and the required electric power in a conventional electric power steering device for a watercraft without a steering retaining device. FIG. 29B is a graph indicating the relationship between the steering amount and the required electric power in a power steering device in accordance with a preferred embodiment of the present invention.

Conventionally, both steering and steering retention are operated by a driving force of an electric motor, and thus a large amount of electric power is required for the steering retention as shown by parts (a) and (b) in FIG. 29A. However, electric power for the steering retention can be saved, as shown by parts (a') and (b') in FIG. 29B, with the power steering device in accordance with preferred embodiments of the present invention. Accordingly, electric power consumption can be largely reduced.

The CPU 152 closes the shut-off valve 148 when the electric power supply to the electric motor 112 is stopped, and controls the stopper hydraulic cylinder 141 to become the steering retaining state such that a steering angle of the outboard motor main body 107 is retained.

Accordingly, a steering retaining force can be maintained in a circumstance when electric power is not sufficiently supplied, such as during a power failure. Further, a steering angle can be fixed, and thereby stability of the hull can be retained in cases when the watercraft is not in use, for example, when the watercraft is towed by another watercraft, and so forth.

Although preferred embodiments of the present invention have been described above, the present invention is not limited to the contents of the above-described preferred embodiments, and various changes are possible within the scope of the claims. For example, with each of the first to fourth preferred embodiments, a case where the entirety of the swivel bracket is preferably formed of the material containing aluminum was described. However, just a portion of the swivel bracket may be formed of the material containing aluminum. Specifically, just a portion positioned in a vicinity of the steering mechanism may be formed of the material containing aluminum. Also, the swivel bracket is not restricted to being formed of the material containing aluminum and may instead be formed of a material containing at least one component among copper, nickel, iron, and carbon fiber resin, for example.

Also, with each of the second and third preferred embodiments, a case where the opening degree of the flow regulating valve is preferably regulated by the user was described. However, the opening degree of the flow regulating valve may be regulated automatically. Specifically, the opening degree of the flow regulating valve may be regulated automatically according to a temperature inside the swivel bracket. Also, the flow regulating valve does not have to be provided.

With the fourth preferred embodiment, a case where the motor cooling member is preferably equipped with both the upper jacket and the lower jacket was described. However, the motor cooling member may be equipped with just one of either the upper jacket or the lower jacket.

Also, with the second preferred embodiment, a case where the water flow passage is preferably provided between the radiating fin and the swivel bracket was described. However, the water flow passage may be provided not just between the swivel bracket and the radiating fin but between the swivel bracket and a member attached to a portion at the outer side of the swivel bracket as well.

Also, with each of the first to fourth preferred embodiments, a case where the driving force of the motor is preferably transmitted by the gear mechanism to the ball screw mechanism was described. However, the mechanism arranged to transmit the driving force of the motor to the ball screw mechanism is not restricted to the gear mechanism and may be a mechanism that includes a belt or a chain.

In the above fifth and sixth preferred embodiments, description is made with respect to an electric steering device of an outboard motor. However, the preferred embodiments of the present invention are not limited to outboard motors, but can be widely applied to electric steering devices of watercrafts including rudders or other similar steering devices (for example, rudder bodies).

In the above fifth and sixth preferred embodiments, description is provided of a case in which the speed reducing gear train 113 and the ball screw device 114 are preferably used as the speed reducing device. However, the preferred embodiments of the present invention are not limited to this construction.

The preferred embodiments of the present invention can be widely applied to general watercraft, pleasure boats, small planing boats, personal watercraft, etc.

The present application corresponds to Japanese Patent Application No. 2009-017661 filed in the Japan Patent Office on Jan. 29, 2009, and the entire disclosure of this application is incorporated herein by reference.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A propulsion device comprising:

a propulsion device main body;

an attachment mechanism arranged to attach the propulsion device main body to a hull such that the propulsion device main body can turn right and left with respect to the hull about a swivel shaft arranged to extend vertically, and turn up and down with respect to the hull about a tilt shaft arranged to extend horizontally along a right/left direction; and a steering mechanism arranged to turn the propulsion device main body to the right and the left with respect to the hull; wherein the steering mechanism includes a motor arranged to generate a driving force to turn the propulsion device main body to the right or the left, and a transmitting mechanism arranged to transmit the driving force of the motor to the propulsion device main body to turn the propulsion device main body to the right or the left;

the attachment mechanism includes a housing space in which the motor and the transmitting mechanism are housed; and the attachment mechanism includes a swivel bracket coupled to the propulsion device main body so as to turn to the right and left about the swivel shaft, the swivel bracket including a front end portion in which the tilt shaft is inserted, and a clamp bracket coupled to the swivel bracket so as to turn up and down about the tilt shaft, and the attachment mechanism is arranged such that the housing space is positioned rearward relative to the front end portion of the swivel bracket in a state in which the propulsion device main body is arranged at a turning origin in regard to an up/down direction.

2. The propulsion device according to claim 1, wherein the attachment mechanism is arranged such that the housing space has a length in the right/left direction that is shorter than a length of the propulsion device main body in the right/left direction.

3. A propulsion device comprising:

a propulsion device main body;

an attachment mechanism arranged to attach the propulsion device main body to a hull such that the propulsion device main body can turn right and left with respect to the hull about a swivel shaft arranged to extend vertically, and turn up and down with respect to the hull about a tilt shaft arranged to extend horizontally along a right/left direction; and a steering mechanism arranged to turn the propulsion device main body to the right and the left with respect to the hull; wherein the steering mechanism includes a motor arranged to generate a driving force to turn the propulsion device main body to the right or the left, and a transmitting mechanism arranged to transmit the driving force of the motor to the propulsion device main body to turn the propulsion device main body to the right or the left;

the attachment mechanism includes a housing space in which the motor and the transmitting mechanism are housed; and the transmitting mechanism includes a ball screw mechanism including a ball screw and a ball nut, and a gear mechanism arranged to transmit the driving force of the motor to the ball screw, and the motor includes an output shaft arranged substantially parallel to the ball screw and coupled to the ball screw via the gear mechanism.

4. The propulsion device according to claim 1, wherein the attachment mechanism is arranged such that the housing space is substantially sealed.

5. The propulsion device according to claim 1, wherein the swivel bracket is arranged to define at least a portion of the housing space, and at least a portion of the swivel bracket is made of a material containing at least one of aluminum, copper, nickel, iron, and carbon fiber resin.

6. The propulsion device according to claim 5, further comprising a control board arranged to control the motor, wherein the swivel bracket is arranged to be in contact with at least one of the motor and the control board.

7. The propulsion device according to claim 5, wherein the swivel bracket includes a recessed portion provided at an outer portion of the swivel bracket, the recessed portion being more recessed than an outer surface of the swivel bracket, and the propulsion device further includes a radiating fin attached to the swivel bracket so as to be housed in the recessed portion.

8. The propulsion device according to claim 7, wherein the recessed portion is provided at the front end portion of the swivel bracket.

9. The propulsion device according to claim 7, wherein the swivel bracket and the radiating fin are arranged such that the radiating fin can be attached to and detached from the swivel bracket.

10. The propulsion device according to claim 5, further comprising a control board arranged to control the motor, and a water flow passage thermally connected to at least one of the motor and the control board, and arranged such that water flows therethrough.

11. The propulsion device according to claim 10, wherein the water flow passage includes a first water flow passage arranged along the swivel bracket at an outside of the swivel bracket.

12. The propulsion device according to claim 11, further comprising a radiating fin attached to an outer portion of the swivel bracket, wherein the first water flow passage is defined by opposing portions of the swivel bracket and the radiating fin.

13. The propulsion device according to claim 10, further comprising a first attachment member arranged inside of the housing space and attached to the motor, and a second attachment member arranged inside of the housing space and attached to the control board, wherein the water flow passage includes a second water flow passage provided inside of the first and second attachment members.

14. The propulsion device according to claim 10, further comprising an engine and a water pump arranged to supply water to the engine and the water flow passage.

15. The propulsion device according to claim 14, further comprising a piping connected to the water flow passage and the water pump, and a flow regulating valve interposed in the piping and arranged to regulate a flow rate of water inside the piping.

16. The propulsion device according to claim 1, wherein the motor includes an output shaft, and the propulsion device further comprises a cooling fan arranged inside the housing space and coupled in an integrally rotatable manner to the output shaft of the motor.

* * * * *